US007922295B2

(12) United States Patent
Kawai et al.

(10) Patent No.: US 7,922,295 B2
(45) Date of Patent: Apr. 12, 2011

(54) ELECTROSTATIC ATTRACTION FLUID EJECTING METHOD AND APPARATUS

(75) Inventors: Hidetsugu Kawai, Kashiba (JP); Shigeru Nishio, Yamatokoriyama (JP); Haruhiko Deguchi, Tenri (JP); Shigeaki Kakiwaki, Nara (JP); Kazuhiro Murata, Tsukuba (JP)

(73) Assignees: Sharp Kabushiki Kaisha, Osaka (JP); National Institute of Advanced Industrial Science and Technology, Tokyo (JP)

( * ) Notice: Subject to any disclaimer, the term of this patent is extended or adjusted under 35 U.S.C. 154(b) by 1303 days.

(21) Appl. No.: 10/569,045

(22) PCT Filed: Aug. 20, 2004

(86) PCT No.: PCT/JP2004/012027

§ 371 (c)(1),
(2), (4) Date: Jul. 17, 2006

(87) PCT Pub. No.: WO2005/021273

PCT Pub. Date: Mar. 10, 2005

(65) Prior Publication Data

US 2007/0195152 A1 Aug. 23, 2007

(30) Foreign Application Priority Data

Aug. 29, 2003 (JP) ..... 2003-209829

(51) Int. Cl.
*B41J 2/06* (2006.01)

(52) U.S. Cl. ..... 347/55; 347/29; 347/73; 347/22

(58) Field of Classification Search ..... 347/73–82, 347/55, 22, 23, 29, 35
See application file for complete search history.

(56) References Cited

U.S. PATENT DOCUMENTS 3,916,421 A * 10/1975 Hertz ..... 347/73

(Continued)

FOREIGN PATENT DOCUMENTS

JP 58-031757 2/1983

(Continued)

OTHER PUBLICATIONS

Koichi Saito, "*Theory of the Electrostatic Suction Type Slit Jet*"; Electronic Imaging & Devices Research Laboratory; Fuji Xerox co. Ltd,; vol. 17-4 (1988); pp. 185-193.

P. J. Birdsey et al.; "*The electric field and the stress on a field-ion specimen*"; Surface Science 23 (1970); pp. 198-210; © North-Holland Publishing Co.

*Primary Examiner* — Matthew Luu
*Assistant Examiner* — Henok Legesse
(74) *Attorney, Agent, or Firm* — Edwards Angell Palmer & Dodge LLP; David G. Conlin; David A. Tucker

(57) ABSTRACT

An ink jet apparatus electrifies ink in a nozzle, and ejects the ink from an ink ejecting hole onto a printing medium by a first electric field generated between the nozzle and the printing medium. The apparatus includes an ink catching device including an ink catching portion adjacent to the nozzle that catches an ejected substance. Between the nozzle and the ink catching portion, the apparatus applies a voltage for generating a second electric field which (i) causes an ejected substance, formed from the ink or the ink whose viscosity is changed, to be ejected from the nozzle, and (ii) causes the ink catching portion to attract the ejected substance. The apparatus, utilizes an electrostatic force to eject fluid, removes a clogging of an ejection head at any position, realizes less initial ejection fluctuation and improves the reliability of ejection.

11 Claims, 28 Drawing Sheets

U.S. PATENT DOCUMENTS

| | | | | | |
|---|---|---|---|---|---|
| 4,160,982 | A | * | 7/1979 | Keur | 347/32 |
| 4,326,204 | A | * | 4/1982 | Erin | 347/76 |
| 4,413,265 | A | * | 11/1983 | Kockler et al. | 347/76 |
| 4,510,503 | A | * | 4/1985 | Paranjpe et al. | 347/14 |
| 4,544,930 | A | * | 10/1985 | Paranjpe | 347/77 |
| 4,621,268 | A | * | 11/1986 | Keeling et al. | 347/82 |
| 5,475,410 | A | * | 12/1995 | Durst et al. | 347/76 |
| 6,328,426 | B1 | | 12/2001 | Chahn et al. | |
| 6,509,917 | B1 | * | 1/2003 | Chwalek et al. | 347/82 |
| 6,796,632 | B2 | * | 9/2004 | Yamada et al. | 347/22 |

FOREIGN PATENT DOCUMENTS

| | | | |
|---|---|---|---|
| JP | 04-016357 | | 1/1992 |
| JP | 04-189548 | | 7/1992 |
| JP | 08-238774 | | 9/1996 |
| JP | 11-268304 | | 10/1999 |
| JP | 1998-071608 | * | 10/1999 |
| JP | 2000-127410 | | 5/2000 |

* cited by examiner

FIG. 4

| | DRAWING | | | | MAINTENANCE | | | | PRELIMINARY EJECTION | | | |
|---|---|---|---|---|---|---|---|---|---|---|---|---|
| ELECTRO-STATIC FIELD APPLYING VOLTAGE | + (150V) | + (150V) | − (−150V) | − (−150V) | + (1000V) | + (1000V) | − (−1000V) | − (−1000V) | + (250V) | + (250V) | − (−250V) | − (−250V) |
| VOLTAGE OF COUNTER ELECTRODE | − (−50V) | 0 (0V) | + (−50V) | 0 (0V) | + (500V) (0 V MAY BE OK) | + (500V) | + (−500V) (0 V MAY BE OK) | − (−500V) | + (50V) (0 V MAY BE OK) | + (50V) | + (−50V) (0 V MAY BE OK) | − (−50V) |
| VOLTAGE OF TO CATCHING PORTION | + (50V) (0 V MAY BE OK) | + (50V) | + (−50V) (0 V MAY BE OK) | + (50V) | − (−500V) | 0 (0V) | + (500V) | 0 (0V) | − (−50V) | 0 (0V) | + (50V) | 0 (0V) |

※ + AND − IN THIS TABLE INDICATE POLARITY OF APPLIED VOLTAGE, AND VOLTAGE IN PARENTHESIS INDICATE EXAMPLE OF APPLIED VOLTAGE (MANUFACTURING OF CONTAINER INTERNAL MEMBER)

(MANUFACTURING OF CONTAINER INTERNAL MEMBER)

(MACHINING OF CONTAINER INTERNAL MEMBER)

(MANUFACTURING OF CONTAINER EXTERNAL MEMBER)

(MANUFACTURING OF CONTAINER EXTERNAL MEMBER)

(CONTAINER EXTERNAL MEMBER AND CONTAINER INTERNAL MEMBER OVERLAP EACH OTHER)

(MANUFACTURING OF UPPER AND LOWER LID MEMBERS)

(MANUFACTURING OF UPPER AND LOWER LID MEMBERS)

(ADHESION)

(PROVIDING ELECTRODE)

(LASER WELDING)

FIG. 22 (a)PRIOR ART

FIG. 22 (b)PRIOR ART

FIG. 22 (c) PRIOR ART

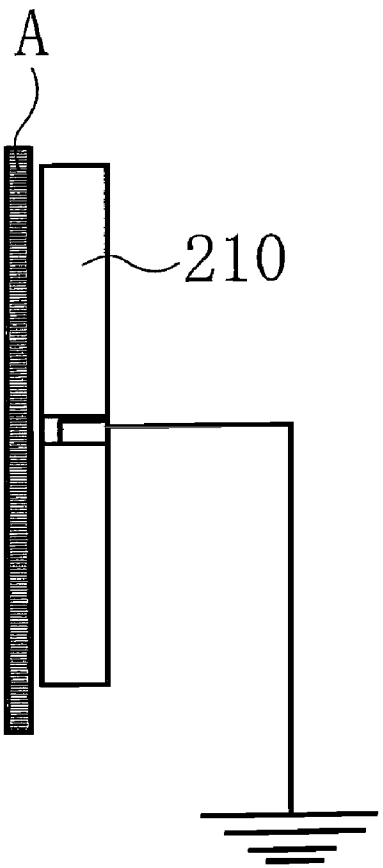
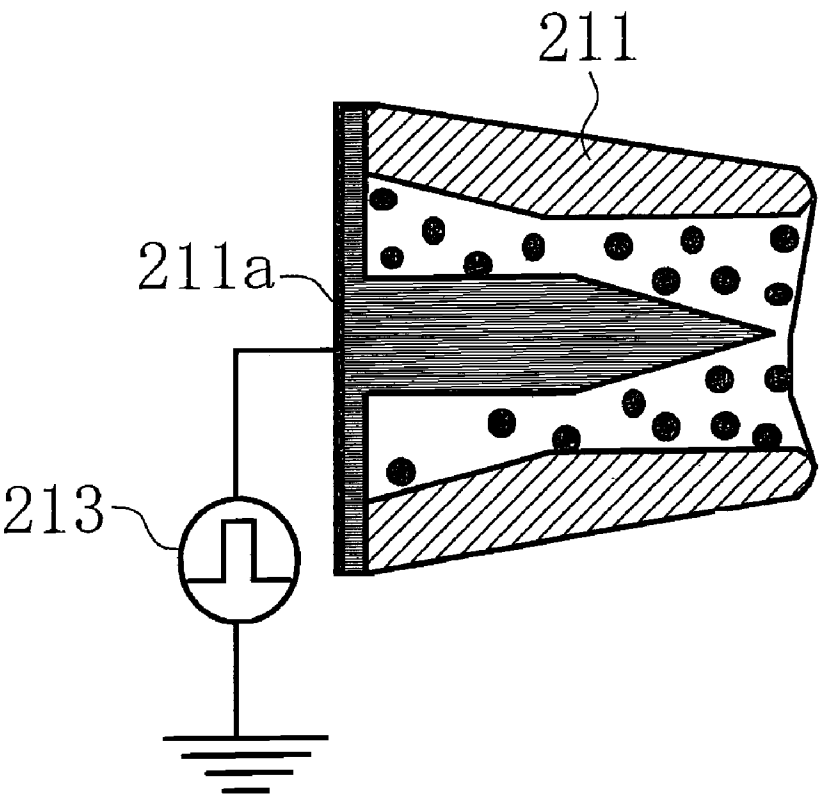
FIG. 26 PRIOR ART

FIG. 28 (a) PRIOR ART
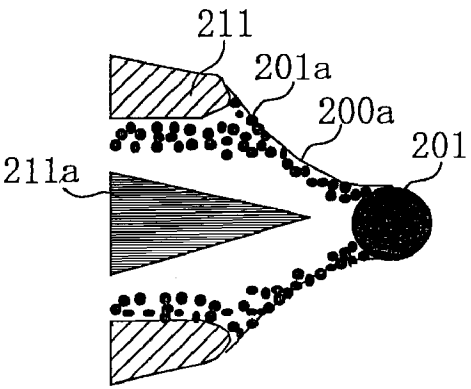
FIG. 28 (b) PRIOR ART
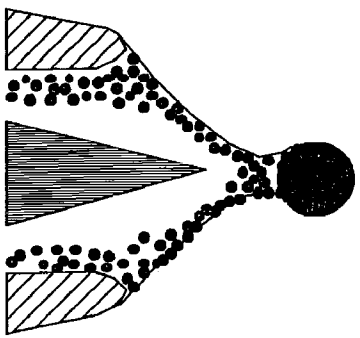
FIG. 28 (c) PRIOR ART
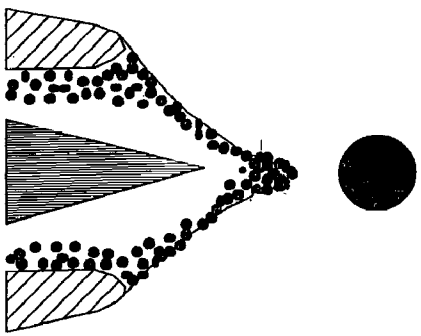

ELECTROSTATIC ATTRACTION FLUID EJECTING METHOD AND APPARATUS

TECHNICAL FIELD

The present invention relates to an electrostatic attraction fluid ejecting method and apparatus for ejecting a fluid, such as ink supplied to a nozzle, onto a target by electrostatically attracting the fluid by electrifying the fluid.

BACKGROUND ART

Generally, there exist various fluid jet methods by which a fluid, such as ink, is ejected onto a target (printing medium). Here, the following will explain an ink jet printing method in which the ink is used as the fluid.

As drop on demand ink jet printing methods, (i) a piezo printing method in which a piezoelectric phenomenon is utilized, (ii) a thermal printing method in which a film boiling phenomenon of ink is utilized, and (iii) an electrostatic attraction printing method in which an electrostatic phenomenon is utilized, etc are developed. Especially, in recent years, a high-resolution ink jet printing method is strongly demanded. To realize the high-resolution ink jet printing, it is indispensable to reduce the size of the ink droplet to be ejected.

Here, the movement of the ink droplet, which is ejected from the nozzle and lands on the printing medium, is expressed by a motion equation (Equation (1)) below.

$$\rho ink\cdot(4/3\cdot\pi\cdot d^3)dv/dt=-Cd\cdot(1/2\cdot\rho air\cdot v^2)\cdot(\pi\cdot d^2/4) \quad (1)$$

The above ρink is a volume density of ink, V is a volume of a droplet, v is a velocity of a droplet, Cd is a drag coefficient, ρair is an air density, and d is a radius of an ink droplet. Cd is expressed by Equation (2) below.

$$Cd=24/Re\cdot(1+3/16\cdot Re^{0.62}) \quad (2)$$

Re in Equation (2) is a Reynolds number. Re is expressed by Equation (3) below.

$$Re=2\cdot d\cdot\rho ink\cdot v/\eta \quad (3)$$

In Equation (3), η is an air viscosity.

The influence exercised by the radius of the droplet on the movement energy of the ink droplet of the left side of Equation (1) is greater than the influence exercised by the radius of the droplet on the viscous resistance of the air of the right side of Equation (1). On this account, when the velocity of the droplet is constant, the smaller the droplet becomes, the more quickly the velocity of the droplet decreases. As a result, the droplet may not be able to reach the printing medium separated by a predetermined distance, or the positioning accuracy of the droplet is low even when the droplet reaches the printing medium.

To prevent these from occurring, it is necessary to increase an initial velocity of the ejected droplet, that is, it is necessary to increase an ejection energy per unit volume.

However, according to the conventional piezo ink jet head and the conventional thermal ink jet head, Problems (A) to (C) below occur when the size of the ejected droplet is decreased, that is, when the ejection energy of the droplet per unit volume is increased. On this account, it was especially difficult to set the amount of the ejected droplet to be equal to or less than 1 pl, that is, difficult to set the diameter (hereinafter referred to as "droplet diameter") of the droplet to be equal to or less than Φ10 μm.

Problem (A): The ejection energy of the piezo ink jet head relates to the amount of displacement and a developed pressure of a piezoid to be driven. The amount of displacement of the piezoid inseparably relates to the amount of the ink ejected, that is, to the size of the ink droplet. To reduce the size of the droplet, it is necessary to reduce the amount of displacement. On this account, it is difficult to improve the ejection energy, per unit volume, of the ejected droplet.

Problem (B): The thermal ink jet head utilizes the film boiling phenomenon of ink. Pressure generated when bubbles are formed is physically limited. Moreover, the ejection energy of the ink is substantially determined by the area of a heating element. The area of the heating element is substantially in proportion to a volume of the bubble formed, that is, in proportion to the amount of ink ejected. On this account, by decreasing the size of the ink droplet, the volume of the bubble formed is decreased. In proportion to this decrease, the ejection energy is also decreased. Therefore, it is difficult to improve the ejection energy, per unit volume, of the ejected droplet of the ink.

Problem (C): In both the piezo printing method and the thermal printing method, how much the drive element (heating element) works relates closely to the amount of ink ejected. Therefore, in the case of ejecting extremely fine droplets, it is very difficult to suppress variations in size of the droplets.

Here, as a method for solving the above problems, a method for ejecting fine droplets by using the electrostatic attraction printing method has been developed.

In the electrostatic attraction printing method, a motion equation of the ink droplet ejected from the nozzle is expressed as Equation (4) below.

$$\rho ink\cdot(4/3\cdot\pi\cdot d^3)dv/dt=q\cdot E-Cd\cdot(1/2\cdot\rho air\cdot v^2)\cdot(\pi\cdot d^2/4) \quad (4)$$

In Equation (4), q is the amount of electric charge of a droplet, and E is a peripheral electric field intensity.

According to Equation (4), in the electrostatic attraction printing method, the ejected droplet receives, in addition to the ejection energy, an electrostatic force while the droplet is flying. Therefore, it is possible to reduce the ejection energy per unit volume and possible to apply the method to the ejection of a fine droplet.

As an ink jet device using such an electrostatic attraction printing method (hereinafter referred to as "electrostatic attraction ink jet device"), Japanese Unexamined Patent Publication No. 238774/1996 (Tokukaihei 8-238774, Document 1) discloses an ink jet device in which an electrode for applying voltages is provided inside the nozzle. Moreover, Japanese Unexamined Patent Publication No. 127410/2000 (Tokukai 2000-127410, Document 2) discloses an ink jet device which has a slit as a nozzle, is provided with a stylus electrode projected from the nozzle, and ejects ink containing fine particles.

Referring to FIG. 21, the following will explain the ink jet device disclosed in Document 1. FIG. 21 is a cross sectional view schematically showing the ink jet device.

In FIG. 21, reference numeral 101 indicates an ink jet chamber, reference numeral 102 indicates ink, reference numeral 103 indicates an ink chamber, reference numeral 104 indicates a nozzle hole, reference numeral 105 indicates an ink tank, reference numeral 106 indicates an ink supplying path, reference numeral 107 indicates a rotating roller, reference numeral 108 indicates a printing medium, reference numeral 110 indicates a control element portion, and reference numeral 111 indicates a process control portion.

Further, reference numeral 114 indicates an electrostatic field applying electrode portion which is provided in the ink chamber 103 of the ink jet chamber 101, reference numeral 115 indicates a counter electrode portion which is a metallic drum provided at the rotating roller 107, and reference numeral 116 indicates a bias power supply portion for applying a negative voltage of thousands of volts to the counter electrode portion 115. Reference numeral 117 indicates a high voltage power supply portion for supplying a high voltage of hundreds of volts to the electrostatic field applying electrode portion 114, and reference numeral 118 indicates a ground portion.

Here, between the electrostatic field applying electrode portion 114 and the counter electrode portion 115, the negative voltage of thousands of volts applied from the bias power supply portion 116 to the counter electrode portion 115 and a high voltage of hundreds of volts from the high voltage power supply portion 117 are superimposed. In this way, a superimposed electric field is generated. The ejection of the ink 102 ejected from the nozzle hole 104 is controlled by means of the superimposed electric field. In addition, reference numeral 119 indicates a projected meniscus which is formed at the nozzle hole 104 by the bias voltage of thousands of volts applied to the counter electrode portion 115.

The following will explain operations of the electrostatic attraction ink jet device configured as above.

First, the ink 102 in the ink tank 105 passes through the ink supplying path 106 by the capillary phenomenon, and is transferred to the nozzle hole 104 of the ink jet chamber 101. At this time, the printing medium 108 is mounted on a surface of the counter electrode portion 115 provided face to face with the nozzle hole 104, and the surface is opposed to the nozzle hole 104.

The ink 102 having reached the nozzle hole 104 forms the projected ink meniscus 119 by the bias voltage of thousands of volts applied to the counter electrode portion 115. Moreover, a signal voltage of hundreds of volts is applied from the high voltage power supply portion 117 to the electrostatic field applying electrode portion 114 which is provided in the ink chamber 103. The signal voltage thus applied is superimposed on the voltage applied from the bias power supply portion 116 to the counter electrode portion 115. Then, by the superimposed electric field, the ink 102 is ejected onto the printing medium 108. As a result, a printed image is formed.

Next, referring to FIGS. 22(*a*) to 22(*c*), the following will explain the movement of the meniscus, until the droplet is ejected, of the droplet of the ink jet device disclosed in Document 1.

As shown in FIG. 22(*a*), before a drive voltage is applied, a projected meniscus 119*a* is formed on the surface of the ink at the nozzle hole 104 because of the balance between (i) the electrostatic force of the bias voltage applied to the ink and (ii) the surface tension energy of the ink.

As shown in FIG. 22(*b*), when the drive voltage is applied, the electric charge generated on the fluid surface starts concentrating on the center of the fluid surface. As a result, a meniscus 119*b* is so formed that the center of the fluid surface is highly projected.

As shown in FIG. 22(*c*), when the drive voltage is continuously applied, the electric charge generated on the fluid surface further concentrates on the center of the fluid surface. This results in the formation of a meniscus 119*c* which is a semilunar shape called "taylor cone". When the electrostatic force of the electric charge concentrated on the top of the taylor cone exceeds the surface tension energy of the ink, a droplet is formed and ejected.

Next, referring to FIG. 23, the following will explain the ink jet device disclosed in Document 2. FIG. 23 is a diagram showing a schematic configuration of the ink jet device.

As shown in FIG. 23, a holding member of the present ink jet device contains (i), as an ink jet head, a line-shaped printing head 211 formed by using low dielectric materials (acrylic resin, ceramics, etc.), (ii) a counter electrode 210 which is made of metal or high dielectric materials and is provided face to face with an ink-ejecting opening of the printing head 211, (iii) an ink tank 212 for storing ink which is made by dispersing electrified pigment particles in nonconductive ink medium, (iv) ink circulating system (pumps 214*a* and 214*b*, pipings 215*a* and 215*b*) for circulating ink between the ink tank 212 and the printing head 211, (v) a pulse voltage generating device 213 which applies a pulse voltage, for ejecting an ink droplet which forms one pixel of a record image, to each ejection electrode 211*a*, (vi) a drive circuit (not shown) which controls the pulse voltage generating device 213 in accordance with image data, (vii) a printing medium feeding apparatus (not shown) which causes a printing medium A to pass through a space between the printing head 211 and the counter electrode 210, (viii) a controller (not shown) which controls the device entirely, etc.

The ink circulating system is composed of (i) two pipings 215*a* and 215*b* each of which connects the printing head 211 with the ink tank 212 and (ii) two pumps 214*a* and 214*b* which are driven by the controller.

The ink circulating system is divided into (i) an ink supplying system which supplies ink to the printing head 211 and (ii) an ink catching system which catches ink from the printing head 211.

In the ink supplying system, the ink is pumped up by the pump 214*a* from the ink tank 212, and the ink thus pumped up is delivered to the ink supplying portion of the printing head 211 through the piping 215*a*. Meanwhile, in the ink catching system, the ink is pumped up by the pump 214*b* from the a catching portion of the printing head 211, and the ink thus pumped up is compulsorily caught in the ink tank 212 through the piping 215*b*.

Moreover, as shown in FIG. 24, the printing head 211 includes (i) an ink supplying portion 220*a* which spreads the ink, supplied from the piping 215*a* of the ink supplying system, so that the ink is spread to be as wide as a line, (ii) an ink flow path 221 which guides the ink, supplied from the ink supplying portion 220*a*, so that the ink forms a mountain-shape, (iii) an ink collecting portion 220*b* which connects the ink flow path 221 with the piping 215*b* of an ink collecting system, (iv) a slit-shaped ink-ejecting opening 222 which is open to the counter electrode 210 at the mountaintop of the ink flow path 221 and has an appropriate width (approximately 0.2 mm), (v) a plurality of ejection electrodes 211*a* which are provided in the ink ejection opening 222 with a predetermined pitch (approximately 0.2 mm), and (vi) party walls 223 which are made of low dielectric materials (for example, ceramic) and are provided on both sides and an upper surface of each ejection electrode 211*a*.

Each of the ejection electrodes 211*a* is made of metals, such as copper, nickel, etc. On the surface of the ejection electrode 211*a*, a low dielectric film (for example, polyimide film), which excels in wettability, for preventing pigments from being adhered is formed. Moreover, the top of each ejection electrode 211*a* is formed like a triangular pyramid. Each ejection electrode 211*a* projects from the ink-ejecting opening 222 toward the counter electrode 210 by an appropriate length (70 μm to 80 μm).

In the above configuration, in accordance with control by the controller, the above-described drive circuit (not shown) gives a control signal to the pulse voltage generating device 213 during a time corresponding to gradation data included in the image data. Then, the pulse voltage generating device 213 superimposes a pulse Vp, whose pulse top corresponds to the kind of the control signal, on the bias voltage Vb so as to output as a high voltage signal a pulse voltage thus superimposed.

When the image data is transferred, the controller drives two pumps 214*a* and 214*b* of the ink circulating system. Then, the ink is delivered from the ink supplying portion 220*a*, and the negative pressure is applied to the ink collecting portion 220*b*. The ink flowing in the ink flow path 221 passes through the gap between the party walls 223 by the capillary phenomenon. Then, the ink spreads so as to reach the top of each ejection electrode 211*a*. At this time, the negative pressure is applied to the surface of each ink fluid near the top of the ejection electrode 211*a*. Therefore, the ink meniscus is formed on the top of each ejection electrode 211*a*.

Further, the controller controls the printing medium feeding apparatus so that the printing medium A is fed in a predetermined direction. Moreover, the controller controls the drive circuit so that the above-described high voltage signal is applied between the printing medium A and the ejection electrode 211*a*.

Referring to FIGS. 25 to 28, the following will explain the movement of the meniscus, until the droplet is ejected, of the droplet of the ink jet device disclosed in Document 2.

As shown in FIG. 25, when the pulse voltage generated by the pulse voltage generating device 213 is applied to the ejection electrode 211*a* in the printing head 211, an electric field, which goes from the ejection electrode 211*a* to the counter electrode 210, is generated. Here, because the ejection electrode 211*a* whose top is sharp is used, the strongest electric field is generated around the top of the ejection electrode 211*a*.

As shown in FIG. 26, when such an electric field is generated, each electrified pigment particle 201*a* in the ink solvent moves toward the surface of the ink fluid by the force fE (FIG. 25) exerted from the electric field. In this way, the density of pigment around the surface of the ink fluid is increased.

As shown in FIG. 27, when the density of pigment is thus increased, a plurality of electrified pigment particles 201*a* around the surface of the ink fluid starts cohering at the opposite side of the electrode. Then, a pigment aggregate 201 starts growing to form a spherical shape near the surface of the ink fluid. Then, the electrostatic repulsive force fcon from the pigment aggregate 201 starts influencing each electrified pigment particle 201*a*. That is, each electrified pigment particle 201*a* is influenced by the total force ftotal which is a resultant force of the electrostatic repulsive force fcon from the pigment aggregate 201 and the force fE from the electric field E generated by the pulse voltage.

Therefore, in the case in which the electrostatic repulsive force between the electrified pigment particles does not excess the force of cohesion of the electrified pigment particles, when the force fE exceeds the electrostatic repulsive force fcon (fE≧fcon), the electrified pigment particles 201*a* form the pigment aggregate 201. Note that, the force fE is applied from the electric field to the electrified pigment particle 201*a* (electrified pigment particle 201*a* which is located on a straight line between the top of the ejection electrode 211*a* and the center of the pigment aggregate 201) to which the total force ftotal in a direction of the pigment aggregate 201 is applied.

The pigment aggregate 201 formed by n pieces of electrified pigment particles 201*a* receives an electrostatic repulsive force FE from the electric field E generated by the pulse voltage, and also receives the binding force Fesc from the ink solvent. When the electrostatic repulsive force FE and the binding force Fesc are balanced, the pigment aggregate 201 becomes stable in a state in which the pigment aggregate 201 projects slightly from the surface of the ink fluid.

Further, as shown in FIGS. 28(*a*) to 28(*c*), when the pigment aggregate 201 grows and the electrostatic repulsive force FE exceeds the binding force Fesc, the pigment aggregate 201 is separated from the surface 200*a* of the ink fluid.

Incidentally, according to the principle of the conventional electrostatic attraction printing method, the meniscus is projected by concentrating the electric charge on the center of the meniscus. The curvature radius of a taylor cone tip portion thus projected is determined by the amount of concentrated electric charge. When the electrostatic force of the amount of concentrated electric charge and the electric field intensity exceeds the surface tension energy of the meniscus, the droplet starts to be ejected.

The maximum amount of electric charge of the meniscus is determined by the physical-property value of the ink and the curvature radius of the meniscus. Therefore, the minimum size of the droplet is determined by the physical-property value of the ink (especially, the surface tension energy) and the intensity of the electric field generated at the meniscus portion.

Generally, the surface tension energy tends to become lower in a fluid containing solvents than in a pure solution. Because typical ink contains various solvents, it is difficult to increase the surface tension energy. On this account, the ink surface tension energy is considered to be constant, and a method of decreasing the size of the droplet by increasing the electric field intensity is used.

Therefore, according to the principle of the ejection of the ink jet device disclosed in each of Documents 1 and 2, an electric field whose intensity is high is generated at the meniscus region whose area is much larger than a project area of the ejected droplet. By the field, the electric charge is concentrated on the center of the meniscus. Then, by an electrostatic force of the concentrated electric charge and the electric field, the ejection is carried out. Therefore, it is necessary to apply an extremely high voltage of about 2,000 V. On this account, it is difficult to control the driving, and there is a problem in view of the safety of the operation of the ink jet device.

(Document 1)

Japanese Unexamined Patent Publication No. 238774/1996 (Tokukaihei 8-238774, published on Sep. 17, 1996)

(Document 2)

Japanese Unexamined Patent Publication No. 127410/2000 (Tokukai 2000-127410, published on May 9, 2000)

(Document 3)

Japanese Unexamined Patent Publication No. 31757/1983 (Tokukaisho 58-31757, published on Feb. 24, 1983)

(Document 4)

Japanese Unexamined Patent Publication No. 189548/1992 (Tokukaihei 4-189548, published on Jul. 8, 1992)

(Document 5)

Japanese Unexamined Patent Publication No. 268304/1999 (Tokukaihei 11-268304, published on Oct. 5, 1999)

To increase the electric field intensity without applying a high voltage, it is necessary to reduce the width or diameter of a portion (ejection starting portion) from which an ink droplet is ejected. With this, it is possible to decrease the size of the electric field which is conventionally large, and it is also possible to drastically reduce the voltage required for the movement of the electric charge, that is, the voltage required for applying to the fluid the electric charge, the amount of which is such that the fluid is electrostatically attracted. Moreover, when the diameter of the fluid-ejecting hole of the nozzle is Φ8 μm or less, the intensity distribution of the electric field concentrates near an ejecting surface of the fluid-ejecting hole. Moreover, the change in the distance between the counter electrode and the fluid-ejecting hole of the nozzle does not influence the intensity distribution of the electric field any more. On this account, it is not necessary to apply a high voltage of 2,000 V which is conventionally necessary. As a result, it is possible to improve safety when using a fluid jet device.

Moreover, because it is possible to reduce the area of the electric field as described above, it becomes possible to generate a high electric field in a small area. As a result, it becomes possible to form fine droplets. On this account, when the droplet is ink, it is possible to realize a high resolution printed image.

Furthermore, because the region where the electric charge is concentrated and the meniscus region of the fluid become substantially the same in size, the amount of time for the electric charge to move in the meniscus region does not influence the response of ejection. As a result, it is possible to improve the velocity of the ejected droplet (print speed when the droplet is an ink).

However, the ink flow path becomes narrow in the case of reducing in size the ejection starting portion (nozzle hole). Therefore, if an ink jet device is left with ink therein, the ink dehydrates and solidifies, or particles in a solution aggregates. This causes clogging of the nozzle hole. Moreover, since an aggregate solidifies easily, the aggregate sticks to an inner surface of the ink flow path. This reduces the cross sectional area of the flow path. Therefore, an ink supply to the ejection starting portion becomes unstable. Thus, the ejection becomes unstable. The clogging or unstable ejection is a major factor for fluctuating the size of the dot formed, causing defects, or decreases the image quality.

Therefore, a method for preventing the clogging or removing the clogging is necessary. The method for preventing the clogging is exemplified by a method for supplying solvent vapor (for example, Tokukaisho 58-31757) and a method for washing (for example, Tokukaihei 4-189548). The method for supplying solvent vapor cannot deal with the clogging caused in the case in which a multichannel ejection head is used and a specific nozzle is not used for a long period of time. Moreover, in the case of the method for washing, it is difficult to wash a head since the head has a small ejection diameter.

Meanwhile, the method for removing the clogging is exemplified by a method for applying a high voltage at a maintenance portion to cause the clogged ink to be ejected (Tokukaihei 11-268304). The following will explain this method in reference to FIG. 29. FIG. 29 is a diagram showing a schematic configuration of an ink jet printing device.

The ink jet printing device includes: a printing head 305 supported by a supporting axis 306; a counter electrode 301 which is opposed to the printing head 305 and holds a printing sheet 302; a purging head 307 provided at a position adjacent to the counter electrode 301; and moving means for causing the printing head 305 to move to a drawing position and a position opposed to the purging head 307. If, in this ink jet printing device, an adhered substance adheres to an ink ejecting portion of the printing head 305 and the printing head 305 is clogged, it is possible to carry out a purging of the printing head 305 in the following manner.

That is, the printing head 305 is moved along the supporting axis 306 from a position in front of the counter electrode 301 to a position opposed to the purging head 307. In this state, between the printing head 305 and the purging head 307, an electric field stronger than an electric field generated when forming a printing dot is generated. With this, an ink droplet is ejected toward the purging head 307 by a stronger electrostatic force. This makes it possible to remove the adhered substance from the ink ejecting portion of the printing head 305.

However, according to the method disclosed in Document 5, it is necessary to move the printing head 305 back to a drawing place after removing the clogging. If the time necessary for this moving back is long, the clogging may occur again, for example, before starting the drawing. On this account, the drawing can be carried out only with respect to a cylindrical printing medium 302 since the time necessary for this moving back is short in this case, and it is difficult to carry out the drawing with respect to a flat medium since the time necessary for this moving back is long in this case. Further, the ejection cannot be carried out in the case of using ink made of a substance which dehydrates in a short period of time, such as ink which dehydrates while the printing head 305 is moving. Moreover, due to, for example, an increase in viscosity of an ejected substance (ink), it is impossible to suppress variations of the amount of ejected ink in an initial ejection.

The present invention was made to solve the above-described problems, and an object of the present invention is to provide electrostatic attraction fluid ejecting method and apparatus which (i) can quickly remove the clogging of an ejection head with a nozzle provided at any position, (ii) cause less variations in an initial ejection and (iii) have high reliability of ejection, in a configuration capable of ejecting fluid by using an electrostatic force.

DISCLOSURE OF INVENTION

To solve the above problem, an electrostatic attraction fluid ejecting apparatus of the present invention electrifies fluid supplied in a nozzle, and ejects the fluid from a nozzle hole onto an ejection target member by a first electric field generated between the nozzle and the ejection target member, and the electrostatic attraction fluid ejecting apparatus includes: catching means, provided at a position adjacent to the nozzle and including a conductive portion, for catching an ejected substance ejected from the nozzle; and voltage applying means for applying a voltage between the nozzle and the conductive portion of the catching means, the voltage being for generating a second electric field which causes the ejected substance, which is formed from the fluid or the fluid whose viscosity is changed, to be ejected from the nozzle and causes the conductive portion to attract the ejected substance.

Moreover, as a regular ejection operation, an electrostatic attraction fluid ejecting method of the present invention electrifies fluid supplied in a nozzle, and ejects the fluid from a nozzle hole onto an ejection target member by a first electric field generated between the nozzle and the ejection target member. In the electrostatic attraction fluid ejecting method, as a preliminary ejection operation or a maintenance operation, (i) catching means, including a conductive portion, for catching an ejected substance ejected from the nozzle is provided at a position adjacent to the nozzle, and (ii) a voltage for generating a second electric field which causes the ejected substance, which is formed from the fluid or the fluid whose viscosity is changed, to be ejected from the nozzle and causes the conductive portion to attract the ejected substance is applied between the nozzle and the conductive portion of the catching means.

According to the above, the first electric field between the nozzle and the ejection target member causes the fluid in the nozzle to be ejected from the nozzle onto the ejection target member, and thus a minute pattern is formed by the fluid to the ejection target member, that is, a drawing is carried out.

If the nozzle is clogged due to a change in viscosity of the fluid in the nozzle, such as an increase in viscosity of the fluid or solidification of the fluid caused due to drying of the fluid, the voltage applying means applies, between the nozzle and the catching means, the voltage for generating the second electric field. This causes the ejected substance to be ejected from the nozzle, and causes the conductive portion of the catching means to attract the ejected substance. Note that the ejected substance is a cause of the clogging of the nozzle and is formed from the fluid or the fluid whose viscosity is changed.

The above-described operation is similar to the preliminary operation carried out for stabilizing the amount of fluid ejected from the nozzle in, for example, an initial operation. The voltage applying means applies, between the nozzle and the conductive portion of the catching means, the voltage for generating the second electric field, so that the ejected substance formed from the fluid can be ejected from the nozzle and the ejected substance can be attracted by the conductive portion of the catching means.

With this, it is possible to easily remove the clogging of the nozzle and easily carry out a preliminary ejection of the fluid from the nozzle. In addition, it is possible to appropriately catch the ejected substance from the nozzle by the conductive portion of the catching means.

Moreover, the catching means is provided at a position adjacent to the nozzle. Therefore even in a drawing operation by the nozzle, it is possible to promptly carry out as needed basis, with the nozzle provided at any position, the maintenance operation for removing the clogging and the preliminary ejection operation for, for example, adjusting the amount of fluid ejected from the nozzle. With this, it is possible to increase the reliability of the electrostatic attraction fluid ejecting apparatus.

Moreover, in the maintenance operation for removing the clogging of the nozzle, it becomes unnecessary to move the nozzle to a maintenance position set separately. Moreover, it is possible to carry out a drawing with respect to the printing medium provided on a flat surface and a drawing using fluid whose drying rate is high, although these drawings cannot be carried out by a conventional electrostatic attraction fluid ejecting apparatus.

In the electrostatic attraction fluid ejecting apparatus, the catching means includes a catching portion which (i) is in the form of a container whose surface opposed to a top portion of the nozzle has an opening, and (ii) has the conductive portion, and the catching portion is provided at a catching position for catching the ejected substance from the nozzle, that is, the catching portion is provided such that a normal line of a central point of a bottom surface of the catching portion passes through the top portion of the nozzle.

According to the above, the catching portion of the catching means is provided at the catching position for catching the ejected substance from the nozzle, that is, the catching portion is provided such that the normal line of the central point of the bottom surface of the catching portion passes through the top portion of the nozzle. Therefore, in the maintenance operation and the preliminary ejection operation, it is possible to surely catch the ejected substance from the nozzle. On this account, it is possible to prevent such a problem that components other than the nozzle is defaced by the ejected substance from the nozzle.

In the electrostatic attraction fluid ejecting apparatus, the catching means includes a catching portion which (i) is in the form of a container whose surface opposed to a top portion of the nozzle has an opening, and (ii) has the conductive portion, and the conductive portion is provided at a bottom wall portion of the catching portion. Note that it is preferable that, in the catching portion, portions other than the electrode portion be made of a low dielectric material. In this case, this low dielectric material may have, for example, a relative dielectric constant ke of 10 or less.

According to the above, since the conductive portion is provided at the bottom wall portion of the catching portion that is in the form of a container, it is possible to appropriately accumulate the ejected substance in the vicinity of the bottom wall portion of the catching portion. Note that the ejected substance from the nozzle is formed from the fluid or the fluid whose viscosity is changed. With this, it is possible to prevent such a problem that the drawing operation by the electrostatic attraction fluid ejecting apparatus becomes unstable due to the interference of an adherence, which is the ejected substance adhered to an external wall surface, with the nozzle or other components of, for example, the drawing system including the electrostatic attraction fluid ejecting apparatus.

Further, it is possible to surely catch the ejected substance from the nozzle in the catching portion. Therefore, it is possible to surely prevent such a problem that the ejected substance, which adheres to the external wall surface of the catching portion, is separated and falls on, for example, the printing medium. Thus, the printing medium and the components of the drawing system are not defaced by the ejected substance.

In the electrostatic attraction fluid ejecting apparatus, on or above the conductive portion in the catching portion, an absorber member capable of absorbing the fluid is provided.

According to the above, it is possible to prevent such a problem that the catching portion and the conductive portion are damaged or defaced by the collision of the ejected substance, from the nozzle in the maintenance operation and the preliminary ejection operation, with these portions. Further, it is possible to prevent such a problem that droplets of the ejected substance fly outside the catching portion.

Note that it is possible to obtain an adequate function even if the material of the absorber member is the low dielectric material. However, it is further preferable to use a conductive material. In this case, an electric flux line(s) from the nozzle reaches a surface of the absorber member, the surface being opposed to the nozzle. Therefore, it is possible to suppress the adherence of the ejected substance with respect to a side surface of the absorber member, and also possible to further improve the stability of absorption of the absorber member.

In the electrostatic attraction fluid ejecting apparatus, the catching means includes a catching portion which (i) is in the form of a container whose surface opposed to a top portion of the nozzle has an opening, and (ii) has the conductive portion, and the conductive portion is provided so as to project from a partial area of a bottom wall portion of the catching portion toward the opening. Note that it is preferable that, in the catching portion, portions other than the electrode portion be made of a low dielectric material. In this case, this low dielectric material may have, for example, the relative dielectric constant ke of 10 or less.

According to the above, since the conductive portion is provided so as to project from the partial area of the bottom wall portion of the catching portion toward the opening, it is possible to appropriately accumulate the ejected substance at a portion (conductive portion) projected from the partial area of the bottom wall portion of the catching portion. Note that the ejected substance from the nozzle is formed from the fluid or the fluid whose viscosity is changed. With this, it is possible to prevent such a problem that the drawing operation by the electrostatic attraction fluid ejecting apparatus becomes unstable due to the interference of an adherence, which is the ejected substance adhered to an external wall surface, with the nozzle or other components of, for example, the drawing system including the electrostatic attraction fluid ejecting apparatus.

Further, it is possible to surely catch the ejected substance from the nozzle in the catching portion. Therefore, it is possible to surely prevent such a problem that the ejected substance, which adheres to the external wall surface of the catching portion, is separated and falls on, for example, the printing medium. Thus, the printing medium and the components of the drawing system are not defaced by the ejected substance.

In the electrostatic attraction fluid ejecting apparatus, wherein the catching means includes: a catching portion having the conductive portion; a supporting portion which supports the catching portion so as to allow the catching portion to move; and a moving portion which causes the catching portion to move to (i) a catching position for catching the ejected substance ejected from the nozzle and (ii) an escaped position which is further from the nozzle than the catching position.

According to the above, in the maintenance operation and the preliminary ejection operation, the catching portion can be provided at the catching position capable of appropriately catching the ejected substance from the nozzle. Moreover, in the drawing operation, the catching portion can be provided at the escaped position which is further from the nozzle than the catching position. Therefore, it is possible to prevent causing such a problem that the existence of the catching portion affects the electric field in the drawing operation. With this, it is possible to carry out the drawing operation highly accurately.

Moreover, since the catching portion is movable, the freedom of the material and shape of the printing medium increases. That is, the freedom of use of the electrostatic attraction fluid ejecting apparatus increases. As a result, regardless of the material, shape and thickness of the printing medium, the printing can be carried out with respect to the printing medium which is difficult to be used conventionally. Further, the freedom of material of an ejected substance increases. That is, the freedom of use of the electrostatic attraction fluid ejecting apparatus increases. As a result, regardless of the evaporation rate of a solution and the rate of increase in viscosity of ink, the printing can be carried out by using a quick-drying ejected material which is difficult to be used conventionally. With this, it is possible to realize the versatile electrostatic attraction fluid ejecting apparatus.

In the electrostatic attraction fluid ejecting apparatus, (I) the catching means includes a catching portion which (i) is in the form of a container whose surface opposed to a top portion of the nozzle has an opening, and (ii) has the conductive portion, (II) the catching portion has (i) a solution path whose one end opens at an external surface of the catching portion and whose another end opens at an internal surface of the catching portion and (ii) a discharging opening for discharging a solution from the catching portion, and (III) the above-described one end of the solution path is connected with solution supplying means for supplying the solution for dissolving the ejected substance caught by the catching portion.

According to the above, it is possible to wash the inside of the catching portion by the solution so as to discharge the ejected substance from the catching portion. Note that the ejected substance from the nozzle is caught in the maintenance operation and the preliminary ejection operation. With this, it is possible to improve the ability of the catching portion to catch the ejected substance and the durability of the catching portion.

In the electrostatic attraction fluid ejecting apparatus, the solution supplying means has a function of controlling the amount of solution supplied to the catching portion, and the discharging opening is connected with collecting means for collecting the solution in the catching portion in accordance with an instruction from the solution supplying means.

According to the above, it is possible to prevent such a problem that the solution supplied to the catching portion is spilled out from the catching portion, and also possible to appropriately carry out the operation of washing the catching portion by the solution and the operation of collecting the solution from the catching portion.

In the electrostatic attraction fluid ejecting apparatus, the catching means includes: a catching portion having the conductive portion; a supporting portion which supports the catching portion so as to allow the catching portion to move; and a moving portion which causes the catching portion to move to (i) a catching position for catching the ejected substance ejected from the nozzle and (ii) an escaped position which is further from the nozzle than the catching position and at which a bottom surface of the catching portion is substantially in parallel with a surface of the solution supplied to the catching portion.

According to the above, it is possible to further surely prevent such a problem that the solution is spilled out from the catching portion, and also possible to carry out the washing of the catching portion further satisfactorily.

In the electrostatic attraction fluid ejecting apparatus, the voltage applying means carries out such a voltage applying operation that the first electric field is higher in intensity than the second electric field.

According to the above, it is possible to surely carry out the maintenance operation for removing the clogging of the nozzle.

The electrostatic attraction fluid ejecting apparatus includes a counter electrode positioned at a back surface of the ejection target member, and in the electrostatic attraction fluid ejecting apparatus, (i) the voltage applying means applies a voltage for generating the first electric field between the nozzle and the counter electrode, and (ii) when generating the second electric field between the nozzle and the conductive portion of the catching means, a voltage applied to the counter electrode is set to have the same polarity as a voltage applied to the nozzle.

According to the above, when generating the second electric field between the nozzle and the conductive portion of the catching means in the maintenance operation and the preliminary ejection operation, the voltage having the same polarity as the voltage applied to the nozzle is applied to the counter electrode. Note that the second electric field is for causing the conductive portion to attract the ejected substance from the nozzle. Therefore, it is possible to surely prevent such a problem that the counter electrode catches the ejected substance from the nozzle.

Moreover, the electrostatic attraction fluid jet apparatus of the present invention can carry out the preliminary ejection in the vicinity of the printing medium, which cannot be carried out by a conventional electrostatic attraction fluid jet apparatus. With this, it is possible to suppress variations of the amount of ejected fluid in the initial ejection. Note that the variations of the amount of ejected fluid is caused due to the increase in the viscosity of the ejected material. Therefore, it is possible to improve the stability of ejection when drawing. On this account, the electrostatic attraction fluid jet apparatus configured as above can satisfy the stability of ejection and have great versatility.

As a regular ejection operation, an electrostatic attraction fluid ejecting method of the present invention electrifies fluid supplied in a nozzle, and ejects the fluid from a nozzle hole onto an ejection target member by a first electric field generated between the nozzle and the ejection target member. In the electrostatic attraction fluid ejecting method, before carrying out the regular ejection operation, as a preliminary ejection operation, (i) catching means, including a conductive portion, for catching an ejected substance ejected from the nozzle is provided at a position adjacent to the nozzle, and (ii) a voltage for generating a second electric field which causes the ejected substance, which is formed from the fluid, to be ejected from the nozzle and causes the conductive portion to attract the ejected substance is applied between the nozzle and the conductive portion of the catching means.

According to the above, before carrying out the regular ejection operation, that is, before carrying out the drawing operation, the fluid is ejected from the nozzle and is caught by the conductive portion of the catching means, that is, the preliminary operation is carried out. Thus, by carrying out the preliminary operation in, for example, a predetermined period of time before carrying out the regular ejection operation, it is possible to suppress variations of the amount of ejected fluid in the initial ejection from the nozzle and possible to improve the stability of ejection. Note that the variations of the amount of ejected fluid are caused due to, for example, the increase in the viscosity of the fluid. Moreover, the time period for the preliminary operation may be suitably changed in accordance with, for example, a characteristic of the electrostatic attraction fluid ejecting apparatus.

In the electrostatic attraction fluid ejecting method, before carrying out the preliminary ejection operation, as a maintenance operation, (i) the catching means, including the conductive portion, for catching the ejected substance ejected from the nozzle is provided at a position adjacent to the nozzle, and (ii) the voltage for generating the second electric field which causes the ejected substance, which is formed from the fluid whose viscosity is changed, to be ejected from the nozzle and causes the conductive portion to attract the ejected substance is applied between the nozzle and the conductive portion of the catching means.

According to the above, the maintenance operation is carried out before the preliminary operation. That is, before the preliminary operation, the ejected substance which is formed from the fluid whose viscosity is changed is ejected from the nozzle and is caught by the conductive portion of the catching means. With this, before the regular ejection operation, it is possible to appropriately remove a factor for causing the ejection from the nozzle to be unstable. With this, it is possible to further surely carry out the satisfactory regular ejection operation.

Additional objects, features, and strengths of the present invention will be made clear by the description below. Further, the advantages of the present invention will be evident from the following explanation in reference to the drawings.

BRIEF DESCRIPTION OF DRAWINGS

FIG. 4 is an explanatory diagram showing an example of relations of potentials of portions of the ink jet apparatus shown in FIG. 1 in the maintenance operation, a preliminary ejection operation and a drawing operation.

FIG. 26 is a diagram for explaining a state of fine particles, when a voltage is applied, at a nozzle portion of the ink jet apparatus shown in FIG. 23.

FIG. 28(*a*) shows movements of a meniscus of ink in the ink jet apparatus shown in FIG. 23, and is an explanatory diagram showing a state in which a pigment aggregate grows at the ink surface, FIG. 28(*b*) shows a state that is after the state shown in FIG. 28(*a*), and is an explanatory diagram showing a state that is before a state in which the pigment aggregate is ejected from the ink surface, and FIG. 28(*c*) is an explanatory diagram showing a state in which the pigment aggregate is ejected from the state shown in FIG. 28(*b*).

BEST MODE FOR CARRYING OUT THE INVENTION

Presupposed Technology

First, the following will explain a presupposed technology of the present invention in reference to the figures.

An electrostatic attraction fluid ejecting apparatus of the presupposed technology of the present invention has a nozzle diameter of 0.01 μm to 25 μm, and can control the ejection of an ejection fluid by a drive voltage of 1,000 V or lower.

In a conventional ink ejection model, the reduction in the nozzle diameter leads to the increase in the drive voltage. Therefore, in the case of the nozzle diameter of 50 μm to 70 μm or smaller, the ink ejection by the drive voltage of 1,000 V or lower is considered to be impossible, as long as a devisal, such as the application of a back pressure to the ejected ink, is not made. However, in the case of a certain nozzle diameter or smaller, it is found that an ejection phenomenon occurs in an ejection model that is different from the conventional ink ejection model. The present presupposed technology is based on a new knowledge of this ink ejection model.

The following will explain the ink ejection model ascertained in the presupposed technology of the present application.

Figure 15:
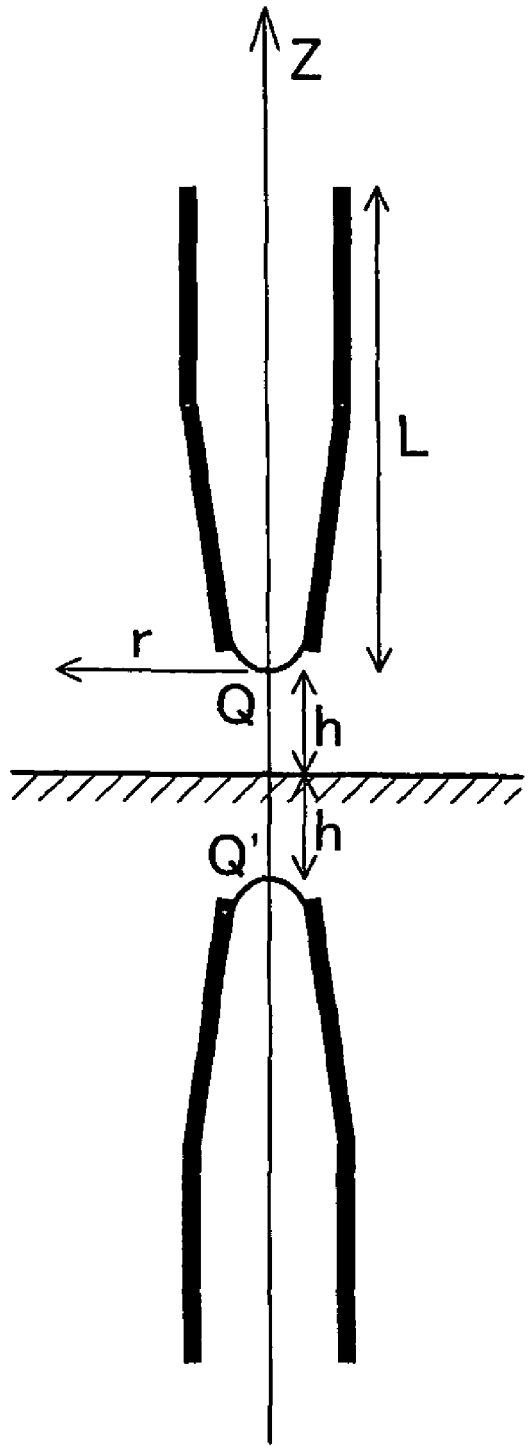
FIG. 15 is an explanatory diagram of an electric field intensity of the nozzle in a presupposed technology of the present invention.

Assume that an conductive ink is injected in a nozzle having a diameter d (d indicates an internal diameter of a nozzle hole in the following explanation, unless otherwise noted) and the nozzle is placed perpendicular to an infinite flat-plate conductor and is placed at a position distanced by h from an infinite flat-plate conductor, which is shown in FIG. 15. Here, assume that electric charge Q induced at a nozzle top (nozzle hole, fluid-ejecting hole) concentrates on a hemispheric portion formed by the ejection fluid at the nozzle top. The electric charge Q is approximately shown by Equation (5) below.

$$Q=2\pi\in_0\alpha V_0 d \tag{5}$$

In Equation (5), Q indicates electric charge (C) induced at the nozzle top, $\in 0$ indicates a dielectric constant (F/m) in a vacuum, d indicates a nozzle diameter (diameter) (m), $V_0$ indicates the total voltage applied to the nozzle. In addition, $\alpha$ indicates the proportionality constant depending on the shape of the nozzle, etc., and is about 1 to 1.5. Especially, when $d \ll h$ (h indicates a distance (m) between the nozzle (nozzle hole) and the substrate), $\alpha$ is approximately 1.

Moreover, in the case of using a conductive substrate as the substrate, mirror image electric charge Q' having a polarity opposite to the polarity of the electric charge Q is considered to be induced at a position, inside the substrate, which is opposed to the nozzle and is symmetrical to the position of the nozzle. In the case of using an insulating substrate as the substrate, video electric charge Q' having a polarity opposite to the polarity of the electric charge Q is induced at a symmetrical position which is determined by the dielectric constant.

A concentrated electric field intensity Eloc at a nozzle top portion is shown by Equation (6) below, where R indicates a curvature radius of the top portion.

$$E_{loc} = \frac{V_0}{kR} \tag{6}$$

In Equation (6), k indicates the proportionality constant depending on, for example, the shape of the nozzle, and is about 1.5 to 8.5. However, in many cases, k is considered to be about 5 (P. J. Birdseye and D. A. Smith, Surface Science, 23 (1970), p. 198-210). In addition, to simplify the ink ejection model, assume that R=d/2 here. This corresponds to a state in which the conductive ink is protruded at the nozzle top portion due to the surface tension energy, so as to be in the form of a hemisphere having a curvature diameter that is the same as the nozzle diameter d.

The following will consider a balance of pressure applied to the ejection fluid at the nozzle top portion. First, an electrostatic pressure $P_e$ is shown by Equation (7) below, where S indicates the area of the fluid at the nozzle top portion, that is, the area of an opening of a nozzle top hole.

$$P_e = \frac{Q}{S}E_{loc} = \frac{2Q}{\pi d^2}E_{loc} \tag{7}$$

Using Equations (5) to (7), the pressure $P_e$ can be shown by Equation (8) below, when $\alpha=1$.

$$P_e = \frac{4\varepsilon_0 V_0}{d}\cdot\frac{2V_0}{kd} = \frac{8\varepsilon_0 V_0^2}{kd^2} \tag{8}$$

Meanwhile, when the pressure by the surface tension energy of the ejection fluid at the nozzle top portion is indicated by $P_s$, the pressure $P_s$ is shown by Equation (9) below.

$$P_s = \frac{4\gamma}{d} \tag{9}$$

In Equation (9), $\gamma$ indicates the surface tension energy. A condition for causing the ejection by the electrostatic force is that the electrostatic force exceeds the surface tension energy. Therefore, the relation between the electrostatic force $P_e$ and the pressure $P_s$ by the surface tension energy is shown as follows.

$$P_e > P_s \tag{10}$$

Figure 16:
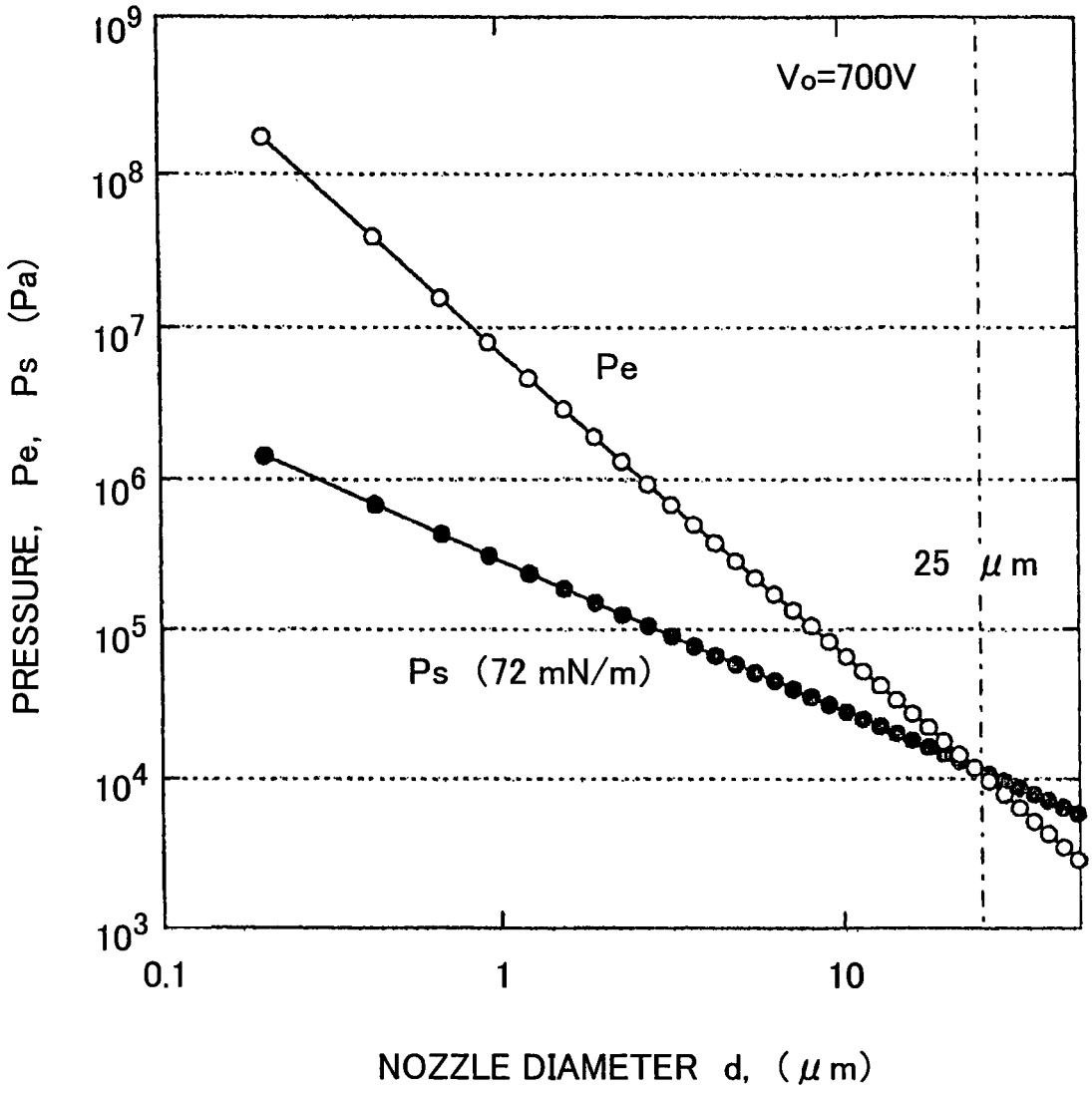
FIG. 16 is a graph showing a result of model calculations concerning (i) a dependency of a pressure by surface tension energy with respect to a nozzle diameter and (i) a dependency of an electrostatic pressure with respect to a nozzle diameter, in the presupposed technology of the present invention.

FIG. 16 shows a relation between the pressure $P_s$ by the surface tension energy and the electrostatic pressure $P_e$, when the nozzle has a certain diameter d. As the surface tension energy of the ejection fluid, assume that the ejection fluid is water ($\gamma$=72 mN/m). If the voltage applied to the nozzle is 700 V, it is indicated that the electrostatic force $P_e$ exceeds the pressure $P_s$ when the nozzle diameter d is 25 μm. With this, the relation between $V_0$ and d is as follows.

$$V_0 > \sqrt{\frac{\gamma k d}{2\varepsilon_0}} \tag{11}$$

This gives the lowest voltage of the ejection.

Moreover, an ejection pressure $\Delta P$ at this time is shown by Equation (12) below.

$$\Delta P = P_e - P_s \tag{12}$$

Therefore, the ejection pressure $\Delta P$ is shown by Equation (13).

$$\Delta P = \frac{8\varepsilon_0 V_0^2}{kd^2} - \frac{4\gamma}{d} \tag{13}$$

Figure 17:
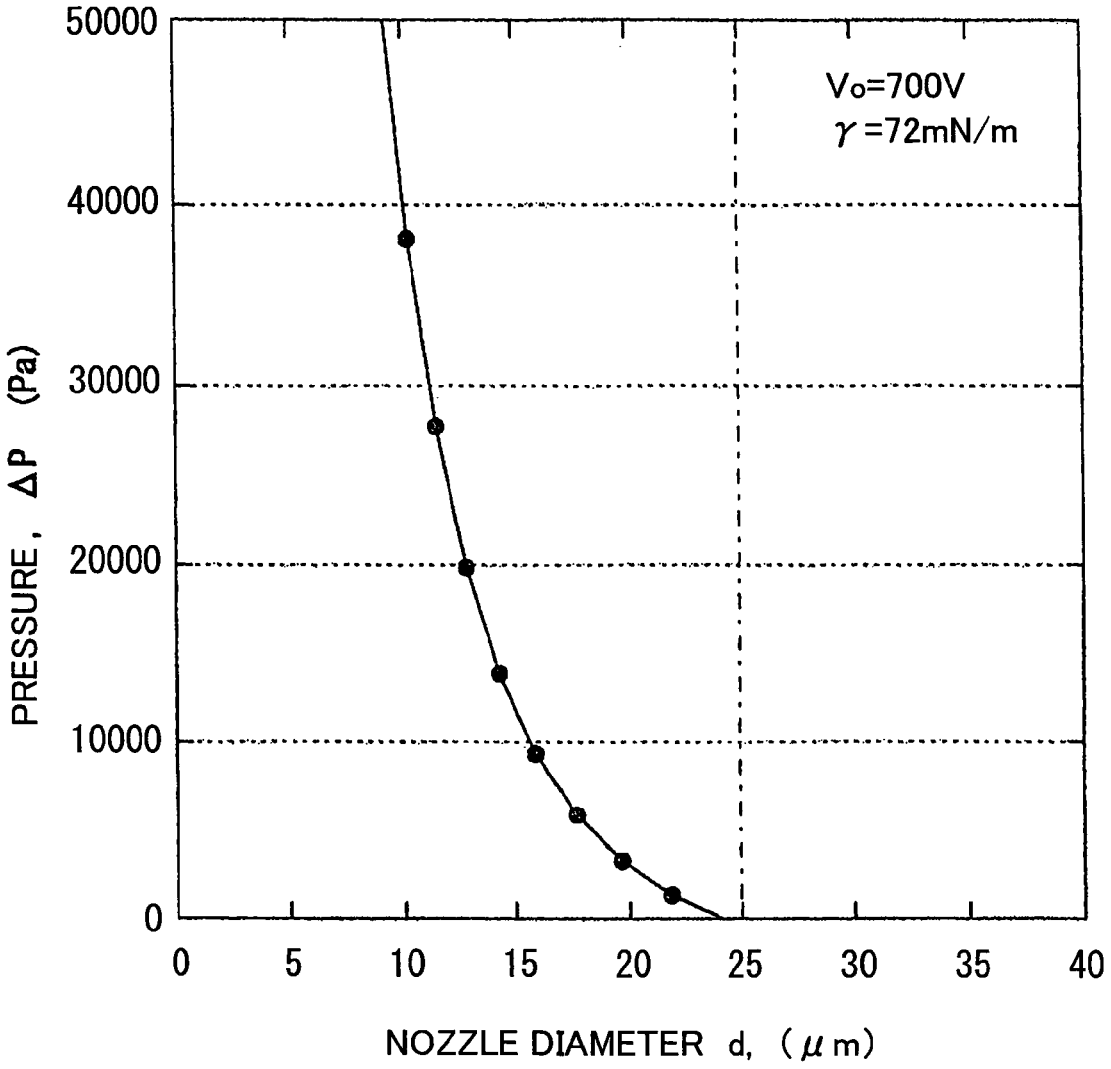
FIG. 17 is a graph showing a result of model calculations concerning a dependency of an ejection pressure with respect to the nozzle diameter, in the presupposed technology of the present invention.
Figure 18:
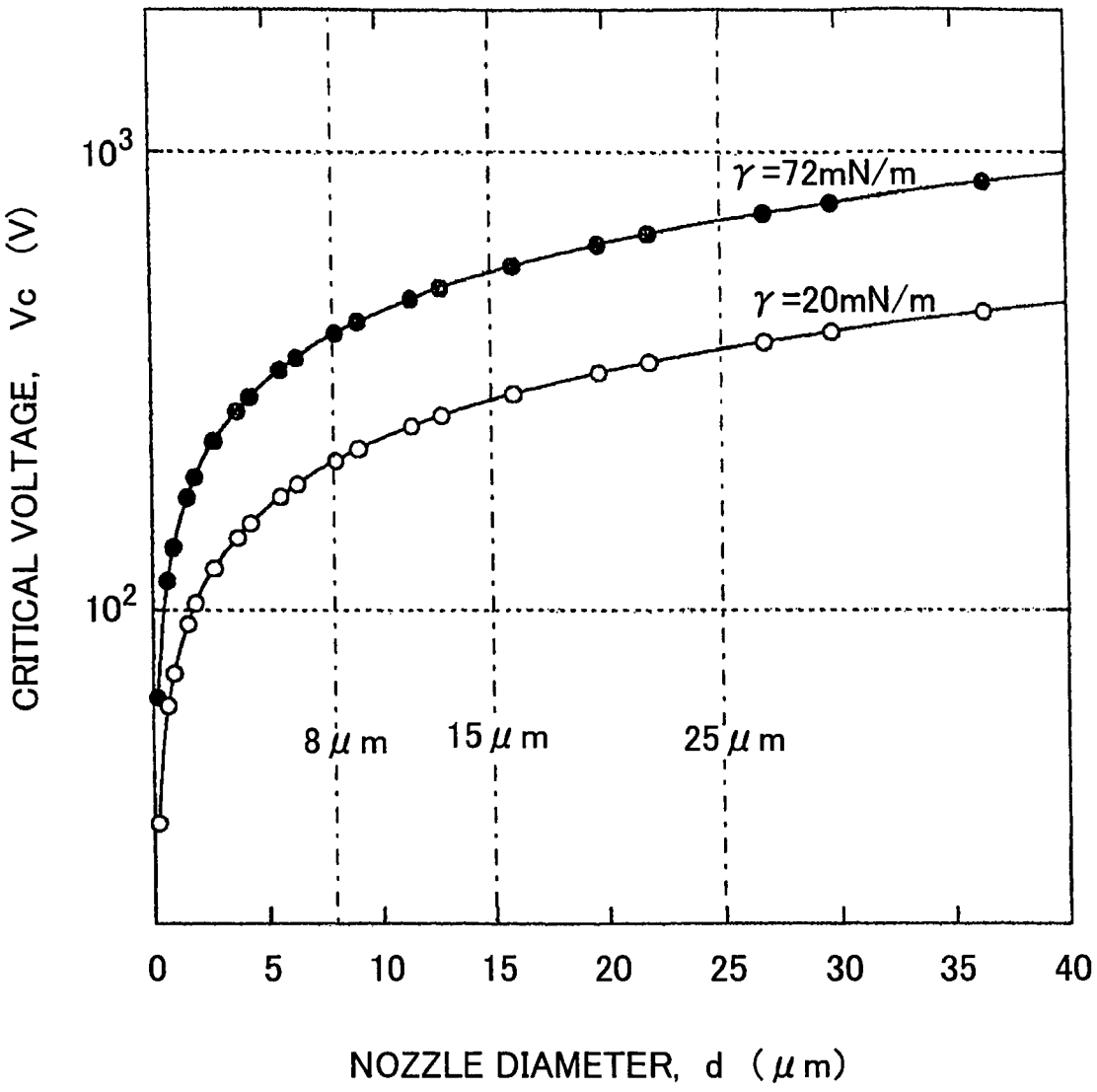
FIG. 18 is a graph showing a result of model calculations concerning a dependency of an ejection limit voltage with respect to the nozzle diameter, in the presupposed technology of the present invention.

FIG. 17 shows the dependency of the ejection pressure $\Delta P$ with respect to the nozzle having a certain diameter d, when the condition for the ejection is satisfied by a local electric field intensity, and FIG. 18 shows the dependency of an ejection critical voltage (that is, the lowest voltage capable of causing the ejection) Vc with respect to the nozzle having a certain diameter d.

It is clear from FIG. 17 that the upper limit of the nozzle diameter is 25 μm when the condition for the ejection is satisfied by the local electric field intensity (in the case of assuming that $V_0$=700 V and $\gamma$=72 mN/m).

In the calculations of FIG. 18, assume that water ($\gamma$=72 mN/m) and organic solvent ($\gamma$=20 mN/m) are used as the ejection fluid and k=5. In the case of taking into consideration the concentration effect of the electric field by a minute nozzle, it is apparent from FIG. 18 that the ejection critical voltage Vc decreases as the nozzle diameter reduces in size. Moreover, it is clear from FIG. 18 that the ejection critical voltage Vc is about 700 V when the ejection fluid is water and the nozzle diameter is 25 μm.

In the case of the idea of the electric field in the conventional ejection model, that is, in the case of taking into consideration only the electric field defined by the voltage $V_0$ applied to the nozzle and a distance h between the nozzle and the counter electrode, the drive voltage necessary for the ejection increases as the nozzle diameter reduces in size.

In contrast, if looking at the local electric field intensity like the ejection model newly suggested in the present presupposed technology, it is possible to reduce the drive voltage for the ejection by reducing the size of the nozzle. Such a reduction in the drive voltage is extremely advantageous for reducing the size of the apparatus and densifying the nozzle. Needless to say, the reduction in the drive voltage realizes the use of a low voltage driver having the high cost performance.

Further, in the above-described ejection model, the electric field intensity necessary for the ejection depends on a local concentrated electric field intensity. Therefore, the existence of the counter electrode is not a must. That is, since the electric field is applied between the nozzle and the substrate in the conventional ejection model, it is necessary to provide with respect to the insulating substrate the counter electrode at the opposite side of the nozzle, or it is necessary that the substrate is conductive. In the case of providing the counter electrode, that is, in the case in which the substrate is an insulator, there is a limit of the thickness of the substrate to be used.

Figure 19:
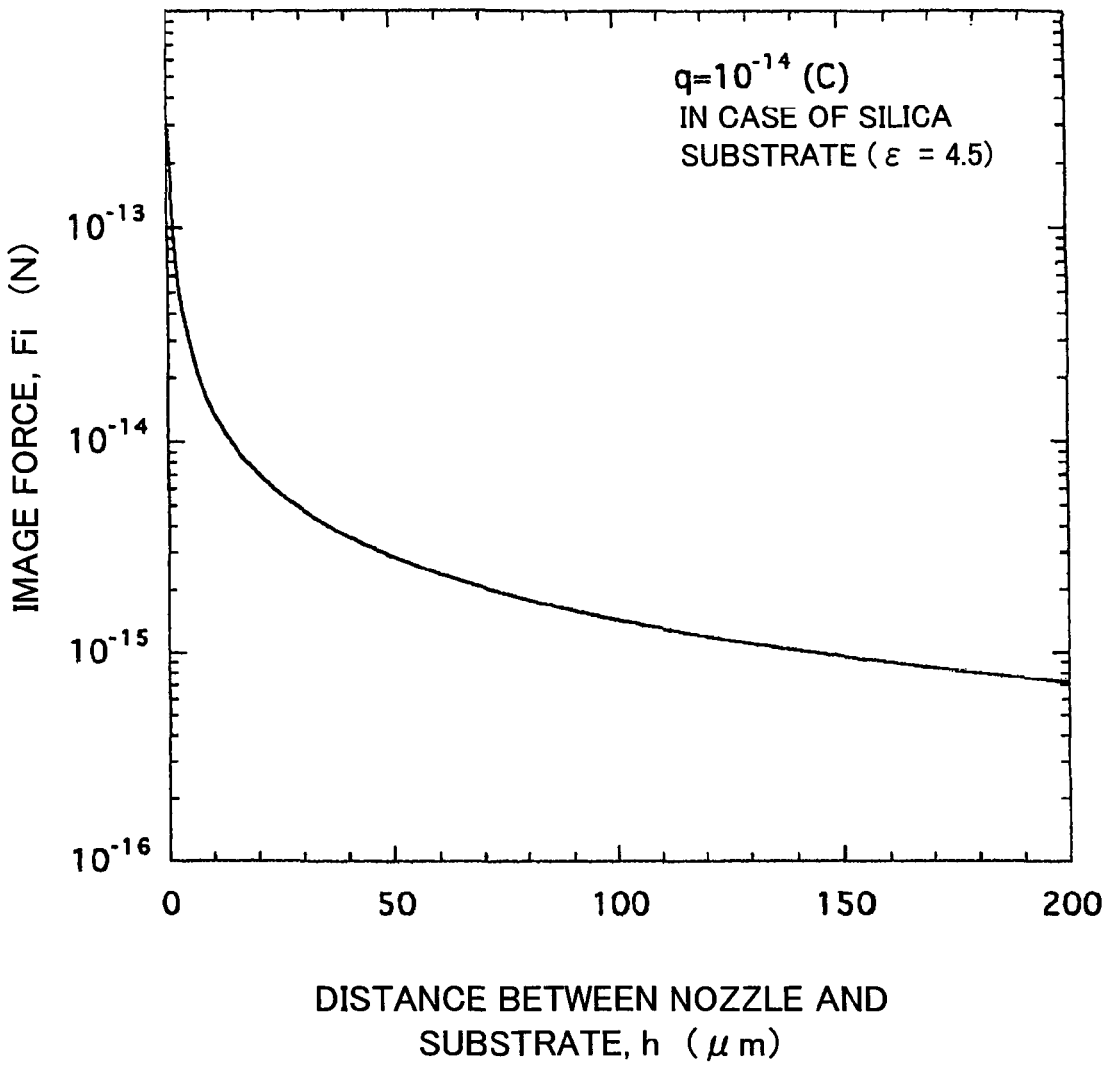
FIG. 19 is a graph showing a relation between (i) an image force between an electrified droplet and a substrate and (ii) a distance between the nozzle and the substrate, in the presupposed technology of the present invention.

In contrast, in the ejection model of the present presupposed technology, it is possible to carry out printing with respect to, for example, the insulating substrate without providing the counter electrode. Therefore, the freedom of configuration of the apparatus increases. Moreover, it is possible to carry out printing with respect to a thick insulator. Note that since the fluid ejected from the nozzle is electrified, the image force works between the fluid and the substrate. FIG. 19 shows the relation between (i) the magnitude of the image force and (ii) the distance h between the substrate and the nozzle.

Next, the following will consider a precise control of the ejection flow volume. In the case of a viscous fluid, the flow volume Q in a cylindrical path is shown by Hagen Poiseuille Equation below. When a cylinder nozzle is used, the flow volume Q in the nozzle is shown by Equation (14) below.

$$Q = \frac{\pi\Delta P}{\eta L}d^4 \tag{14}$$

In Equation (14), $\eta$ indicates a viscosity coefficient (Pa·s) of the fluid, L indicates a length (m) of a flow path (nozzle), d indicates a diameter (m) of the flow path (nozzle), and $\Delta P$ indicates a pressure difference (Pa). Equation (14) indicates that the flow volume Q is proportional to the fourth power of the radius of the flow path. Therefore, the flow volume can be effectively controlled by using a minute nozzle. The ejection pressure ΔP obtained by Equation (13) is used in the Equation (14), and Equation (15) below is obtained.

$$Q = \frac{4\pi d^3}{\eta L}\left(\frac{2\varepsilon_0 V_0^2}{kd} - \gamma\right) \tag{15}$$

Figure 20:
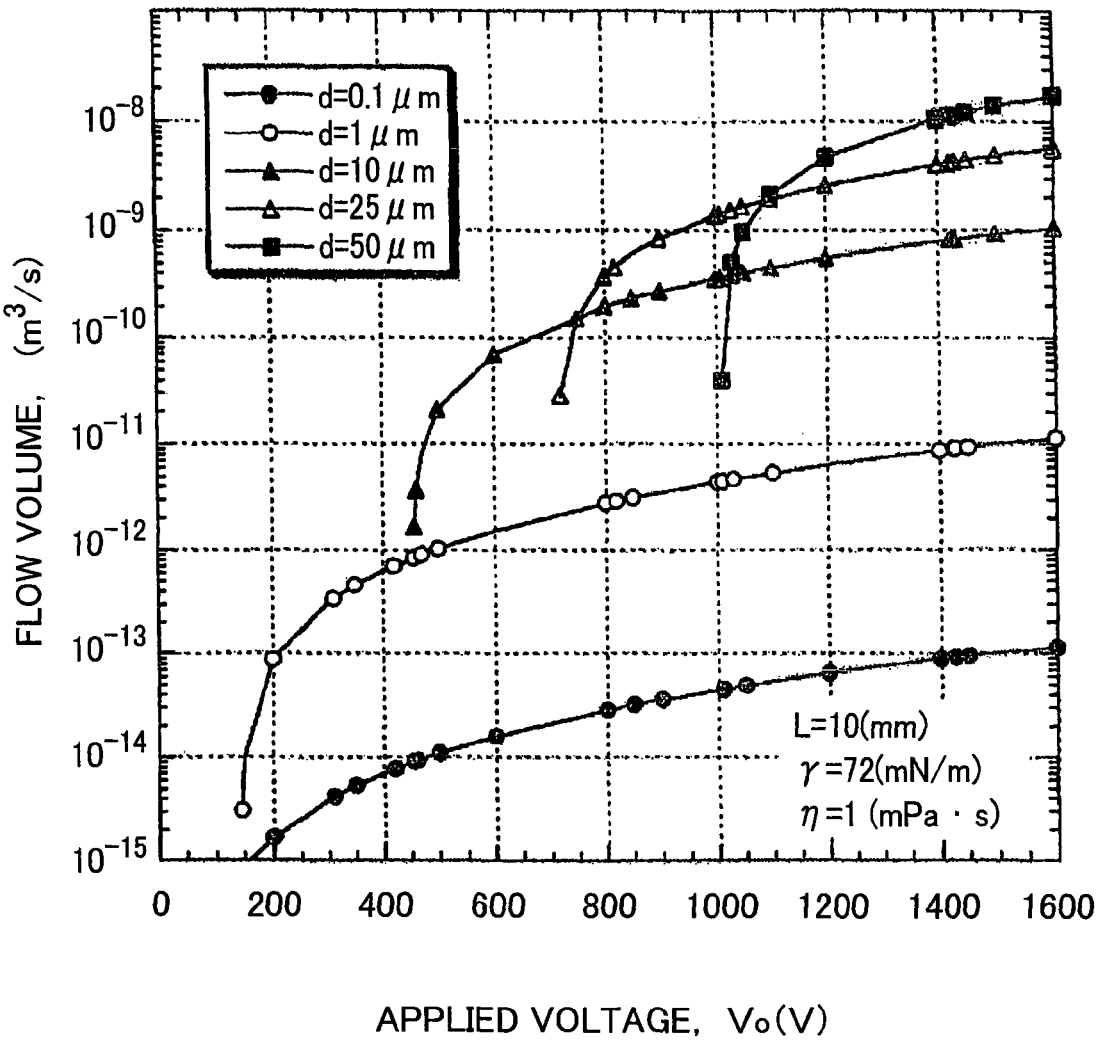
FIG. 20 is a graph showing a model calculation result of a relation between the flow volume of fluid from the nozzle and an applied voltage, in the presupposed technology of the present invention.
Figure 21:
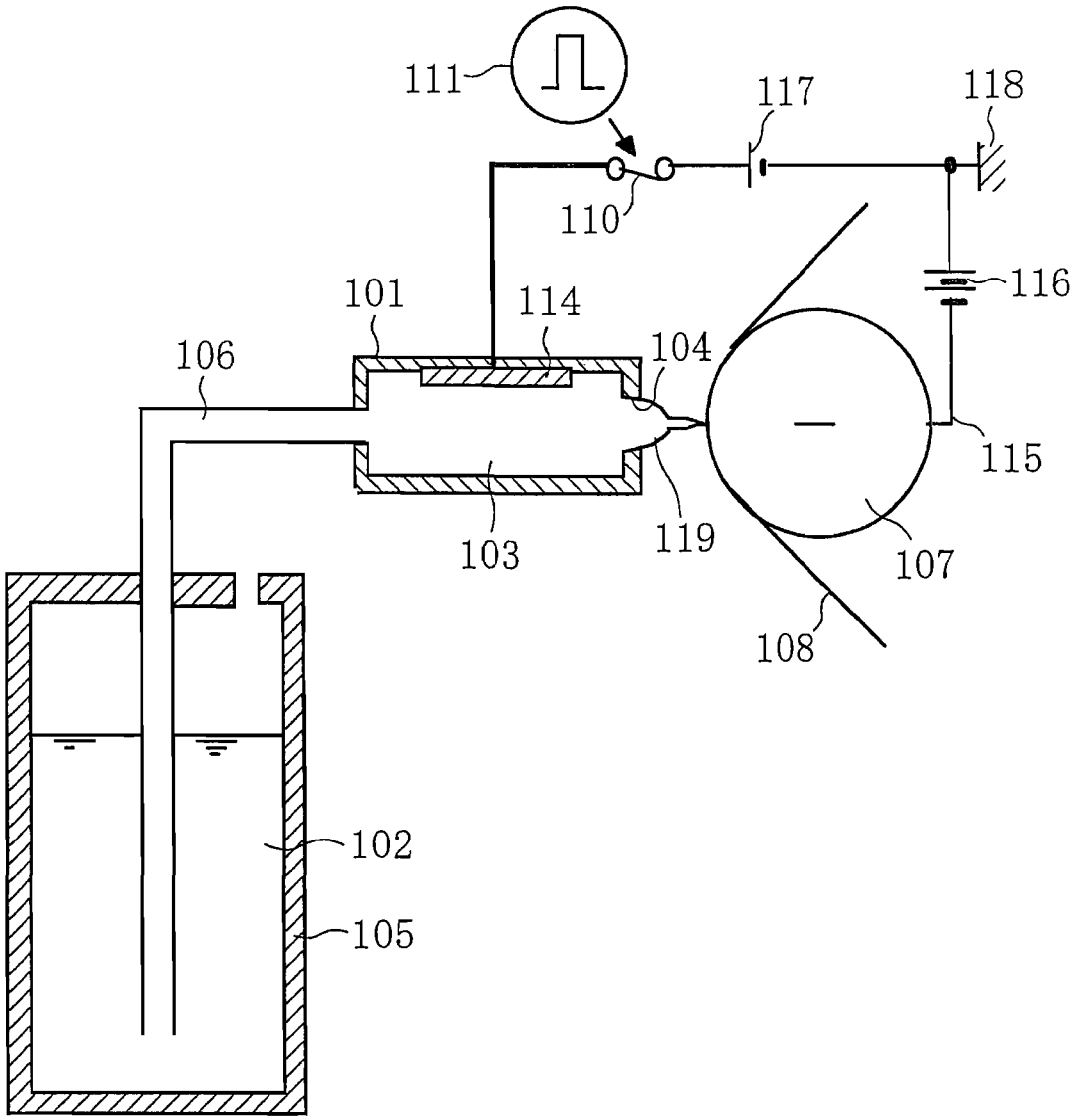
FIG. 21 PRIOR ART
FIG. 21 is a cross sectional view of a schematic configuration of a conventional electrostatic attraction ink jet apparatus.
Figure 22:
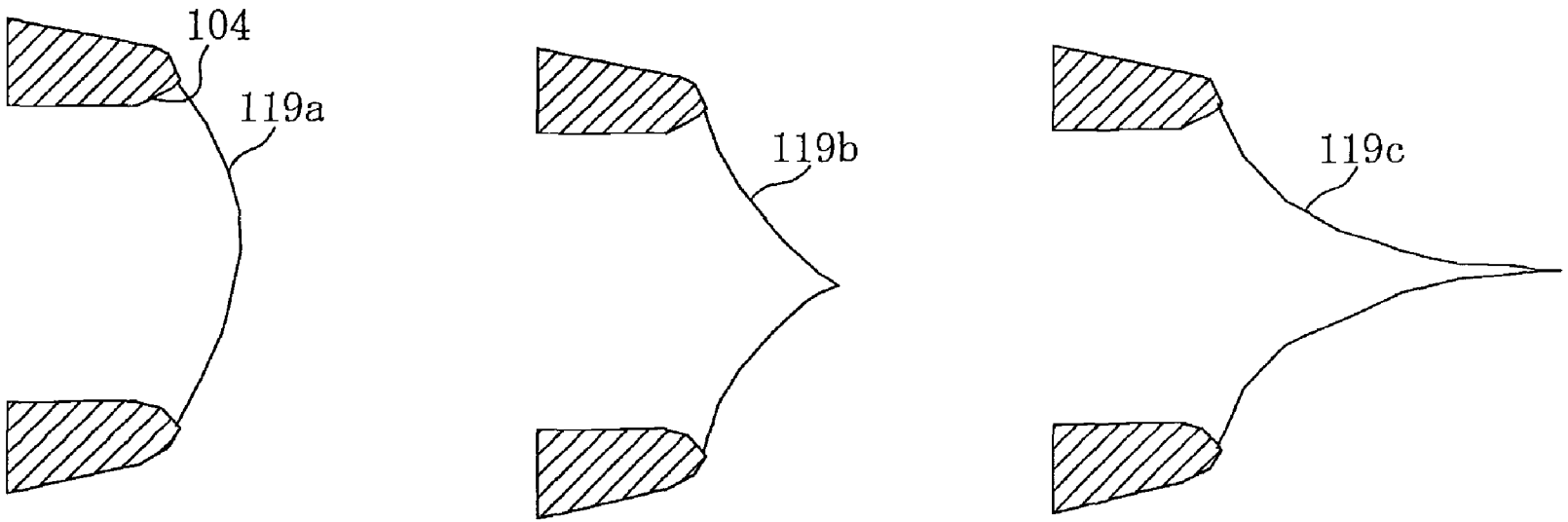
FIG. 22(*a*) shows movements of a meniscus of ink in the ink jet apparatus shown in FIG. 21, and is an explanatory diagram showing a state in which the protruded meniscus is formed on the ink surface, FIG. 22(*b*) is an explanatory diagram showing a state in which the center of the protrusion of the fluid becomes higher by an electric charge generated on a fluid surface than that of the case shown in FIG. 22(*a*), and FIG. 22(*c*) is an explanatory diagram showing a state, changed from the state shown in FIG. 22 (*b*), in which a taylor cone meniscus is formed due to further concentration of the electric charge generated on the surface of the fluid.
Figure 23:
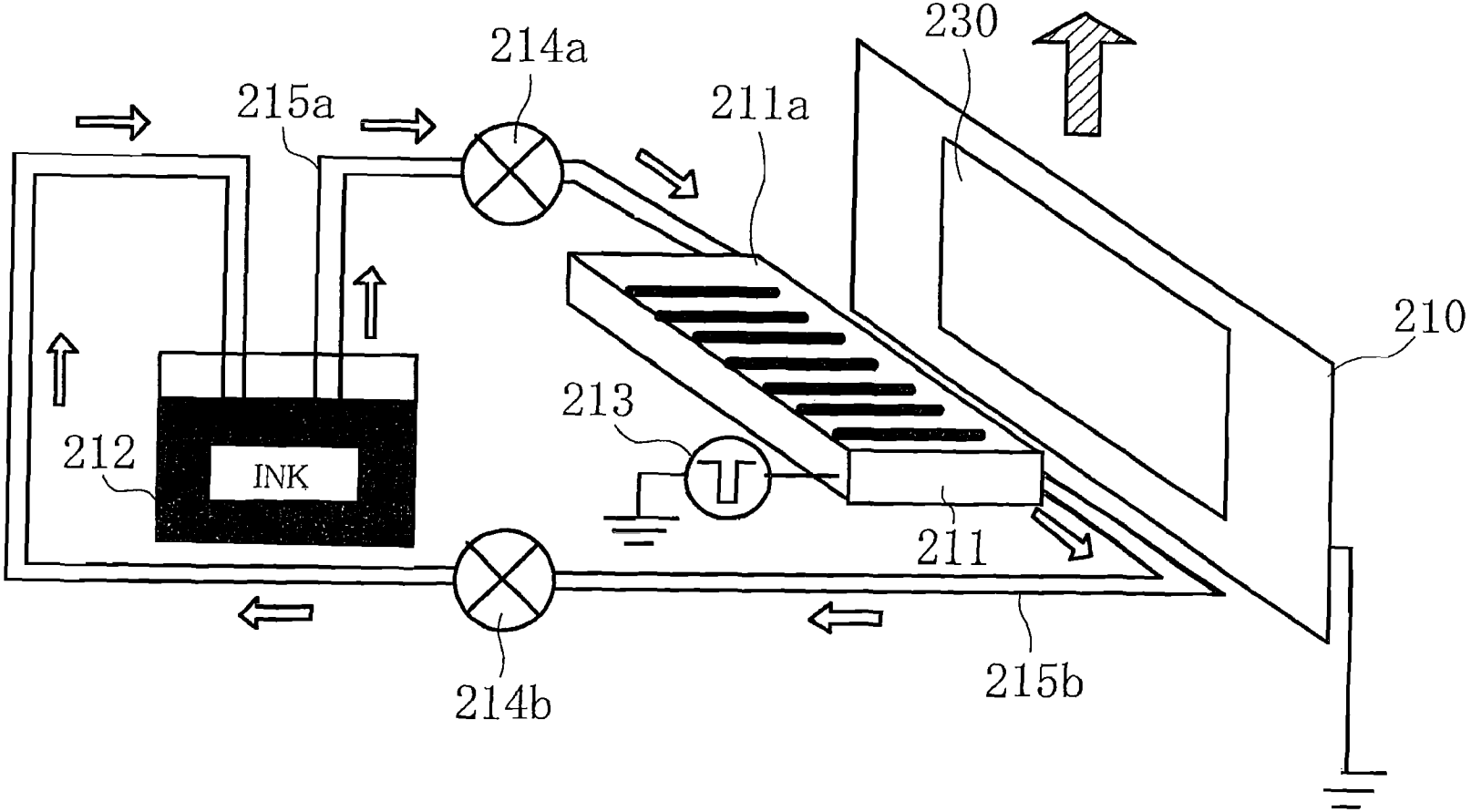
FIG. 23 PRIOR ART
FIG. 23 is a diagram of a schematic configuration of another conventional electrostatic attraction ink jet apparatus.
Figure 24:
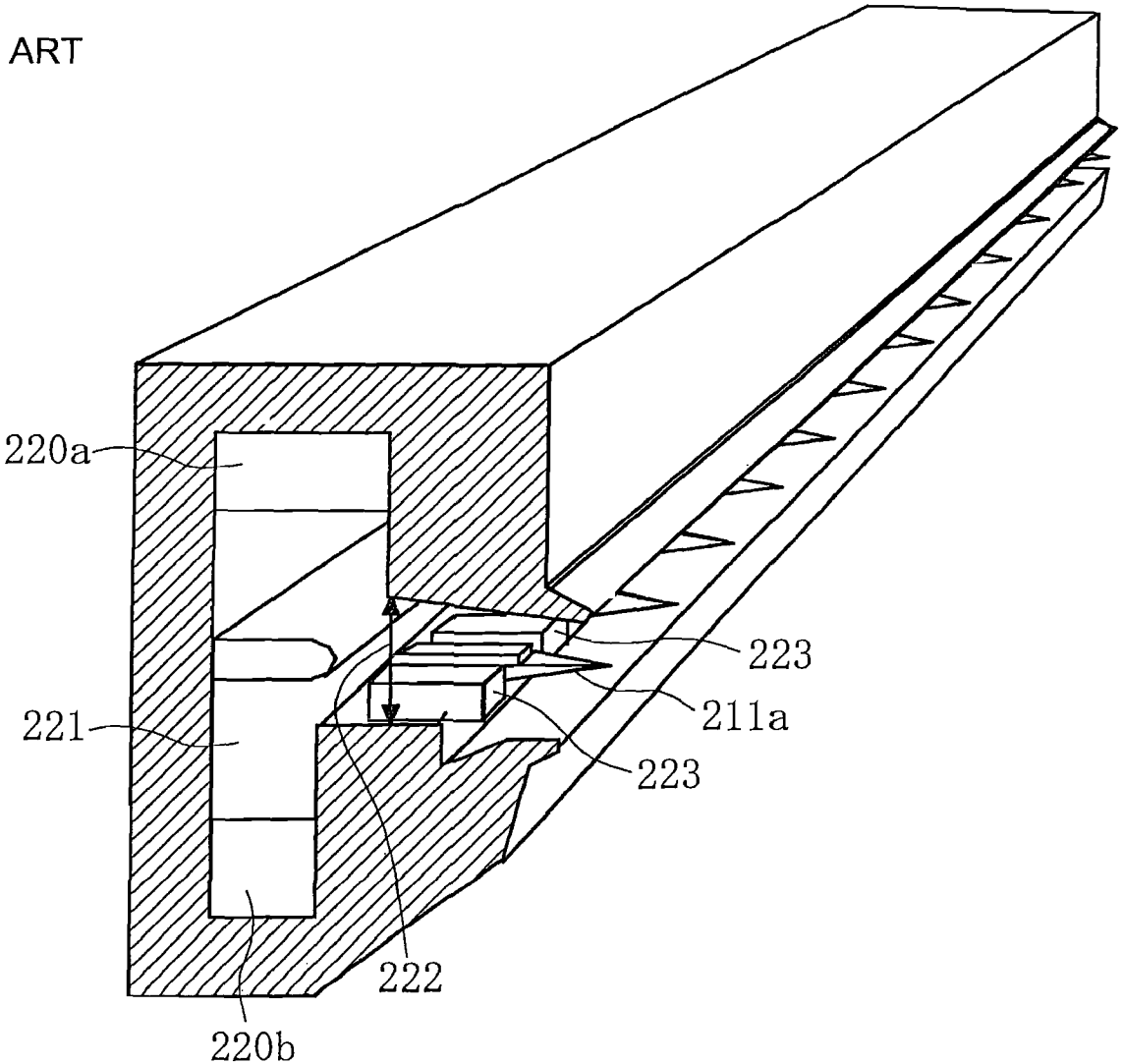
FIG. 24 PRIOR ART
FIG. 24 is a schematic cross sectional perspective view of a nozzle portion of the ink jet apparatus shown in FIG. 23.
Figure 25:
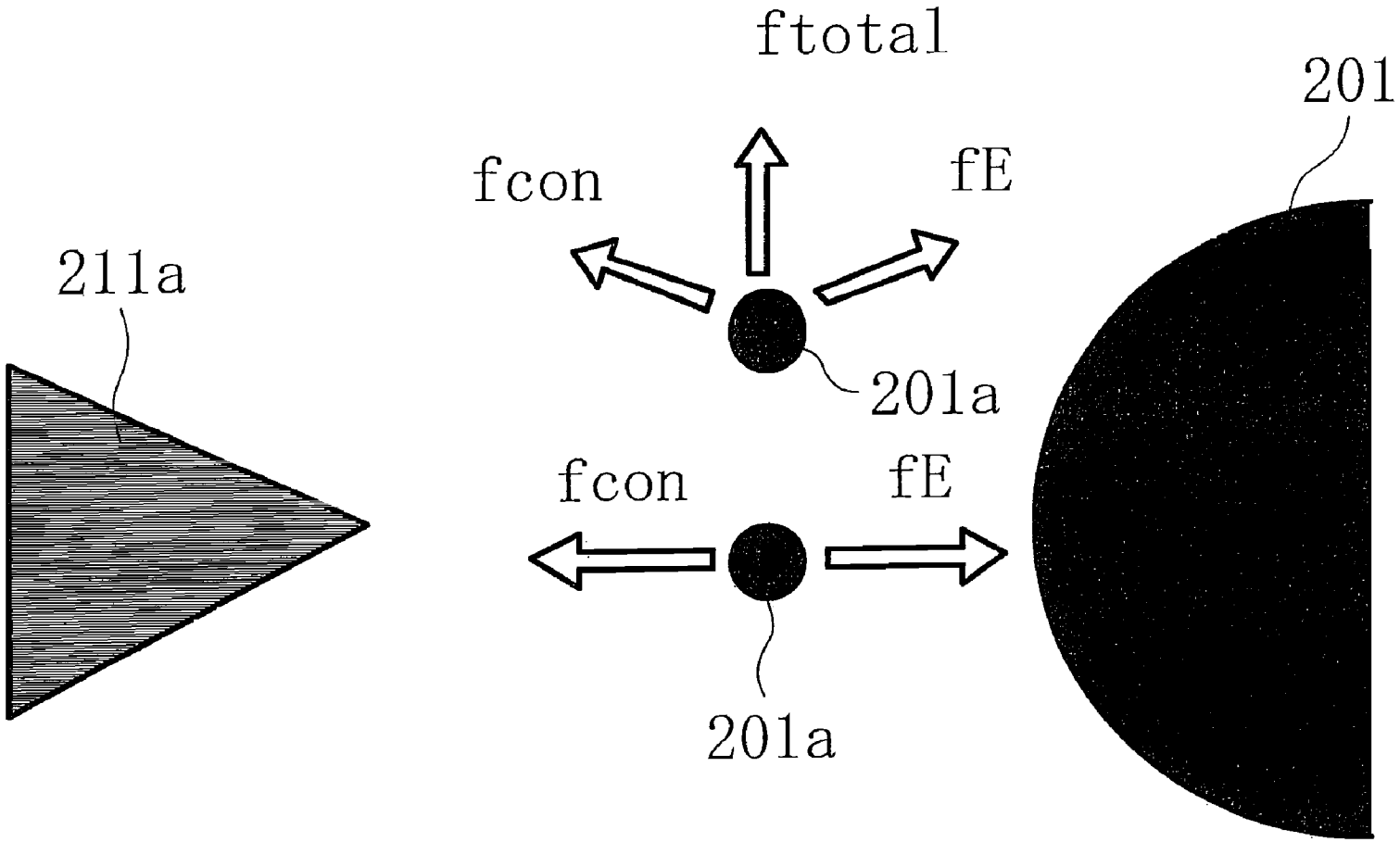
FIG. 25 PRIOR ART
FIG. 25 is a diagram for explaining a principle of an ink ejection of the ink jet apparatus shown in FIG. 23.
Figure 27:
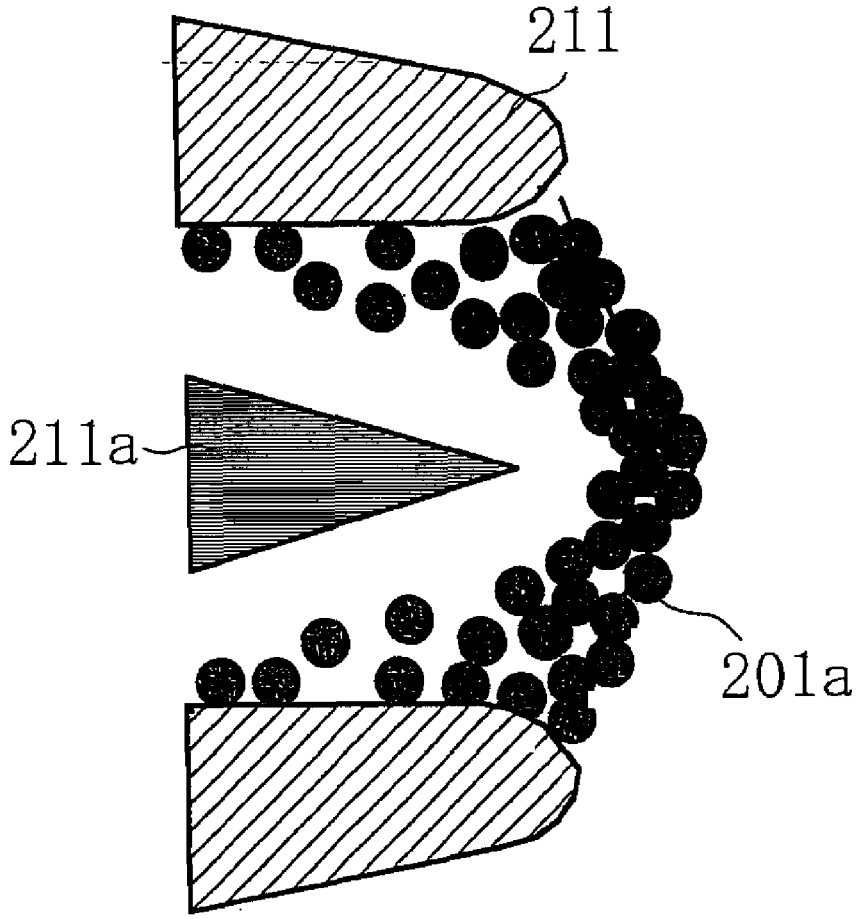
FIG. 27 PRIOR ART
FIG. 27 is a diagram for explaining a principle for forming an aggregate of fine particles at the nozzle portion of the ink jet apparatus shown in FIG. 23.
Figure 29:
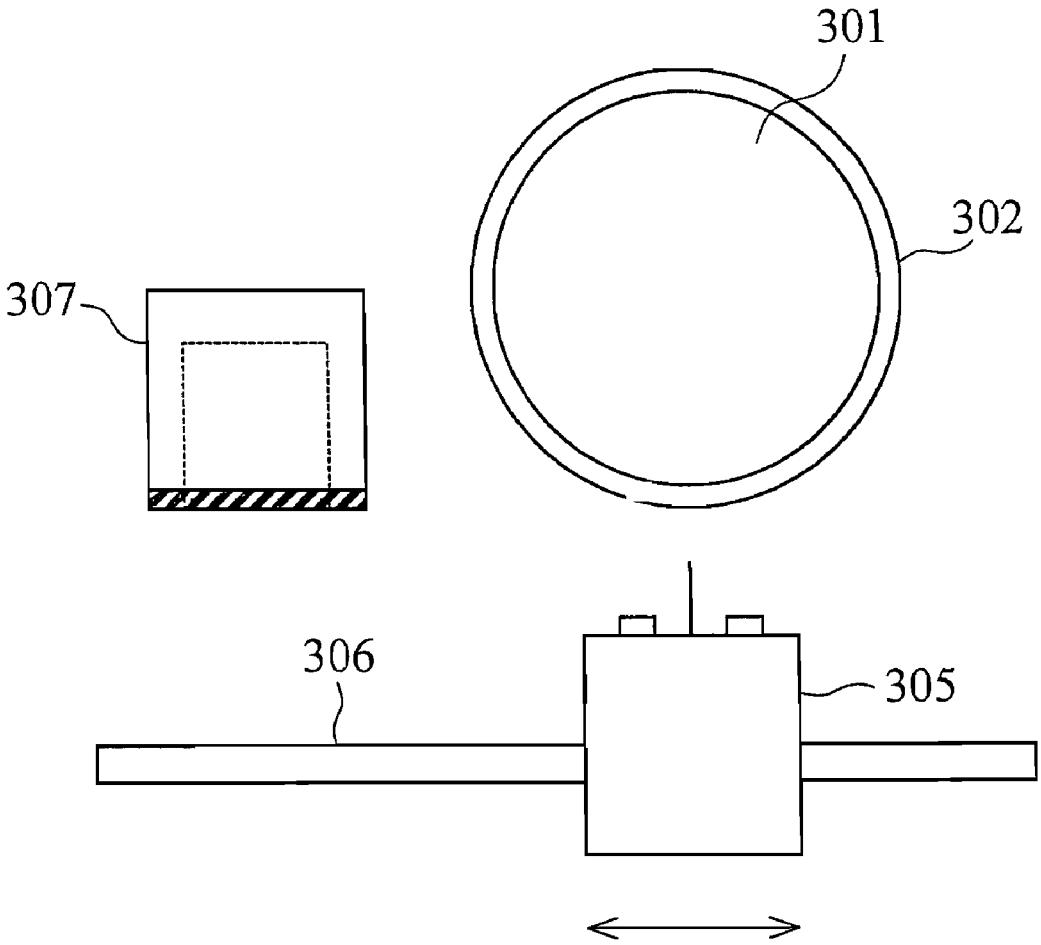
FIG. 29 PRIOR ART
FIG. 29 is a diagram of a schematic configuration of still another conventional electrostatic attraction ink jet apparatus.

Equation (15) indicates the amount of fluid flowing out of a nozzle having a diameter d and a length L, when a voltage V is applied to the nozzle, which is shown in FIG. 20. The amount is calculated on condition that L=10 mm, η=1 (mPa·s), γ=72 (mN/m). In this case, the diameter of nozzle is assumed to be 50 μm that is the minimum diameter among the conventional nozzles. The voltage V is gradually applied, and the ejection is started when the voltage V is 1,000 V, which corresponds to an ejection-start voltage described in FIG. 18. The Y axis indicates the flow volume of fluid from the nozzle. The flow volume jumps right after the ejection-start voltage Vc. According to this model calculation, a micro flow volume appears to be obtained by precisely setting the voltage to a value slightly above Vc. However, as can be seen in the semilog diagram, it is not possible in actual operation, particularly for a volume below $10^{-10}$ $m^3/s$. Moreover, as explained above with Equation (11), the lowest drive voltage for a nozzle having a certain diameter is automatically determined. Therefore, ejection of fluid less than $10^{-10}$ $m^3/s$, or application of voltage less than 1,000 V is not practically realistic as long as the nozzle diameter is 50 μm or more as in the conventional art.

As can be seen in FIG. 20, a nozzle having a diameter of 25 μm can be easily controlled by a drive voltage of 700 V or less. Moreover, a nozzle having a diameter of 10 μm can be controlled by a drive voltage of 500 V or less. Further, a nozzle having a diameter of 1 μm can be controlled by a drive voltage of 300 V or less.

The foregoing consideration was presented with an assumption that the fluid is ejected as a continuous flow. The following will explain why a switching operation is required to form dots.

The ejection by the electrostatic attraction is based on electrification of the fluid at a nozzle edge portion. The electrification speed is estimated at around the time constant, which depends on the dielectric relaxation.

$$\tau = \frac{\varepsilon}{\sigma} \tag{16}$$

In Equation (16), ∈ indicates a relative dielectric constant of a fluid, and σ indicates the conductivity of the fluid ($S \cdot m^{-1}$). Assuming that the relative dielectric constant of the fluid is 10, and the conductivity of the fluid is $10^{-6}$ S/m, $\tau = 1.854 \times 10^{-5}$ sec. Further, if the critical frequency is indicated by fc, fc is shown by Equation (17) below.

$$f_c = \frac{\sigma}{\varepsilon} \tag{17}$$

Accordingly, it is not possible to follow a change in the electric field at a frequency higher than fc, that is, the ejection does not occur. A frequency of about 10 kHz is estimated for the case above.

Next, the following will consider a decrease in the surface tension energy in the nozzle. By providing an insulator on an electrode and applying a voltage between the fluid ejected onto the insulator and the electrode, the contact area of the fluid and the insulator can be increased, in other words, wettability improves. This phenomenon is known as Electrowetting. This effect also works for a cylindrical capillary, in which case it is often called Electrocpapillary. The relation among (i) pressure due to Electrowetting, (ii) an applied voltage, (iii) the shape of a capillary, and (iv) a physical-property value of solvent is shown by Equation (18) below.

$$P_{ec} = \frac{2\varepsilon_0 \varepsilon_r}{t}\frac{V_0^2}{d} \tag{18}$$

In Equation (18), $\in_0$ indicates a dielectric constant in a vacuum, $\in_r$ indicates a dielectric constant of an insulator, t indicates the thickness of an insulator, and d indicates the internal diameter of a capillary. Adopting this Equation with an assumption that the fluid is water, the case described in Example of the above-described Document 1 was examined, with a result of 30,000 Pa (0.3 atmosphere), which is not so significant. On the other hand, the same examination was carried out for the presupposed technology with the result of about 30 atmospheres when an electrode is provided outside the nozzle. With this effect, the fluid is quickly supplied to the nozzle top portion even in the case of using the minute nozzle. This effect becomes more significant as the dielectric constant of the insulator increases, and as the thickness of the insulator decreases. Strictly, the electrode needs to be placed on an insulator to obtain Electrocapillary; however, the effect can still be obtained as long as a sufficient electric field is applied to a sufficient insulator.

However, it should be noted in presenting this approximate theory that the intensity of the electric field in this case denotes not the conventional sense of electric field which depends on the voltage $V_0$ applied to the nozzle and the distance h between the nozzle and the counter electrode, but the intensity of a local concentrated electric field at the nozzle top. Further, an important feature of the presupposed technology is the use of a local strong electric field, and a fluid-supplying path having significantly small conductance. Also, in the present invention, the fluid is sufficiently electrified even in a micro area. On this account, when a dielectric substance, such as a substrate, or an electric conductor approaches, the small amount of electrified fluid is ejected at right angles with respect to the substrate due to the image force. Considering this structure, a glass capillary is used in Embodiments below because of its simple fabrication; however, the present invention is not limited to this.

Embodiment 1

The following will explain one embodiment of the present invention. Note that the present embodiment will explain an electrostatic attraction ink jet apparatus as an electrostatic attraction fluid ejecting apparatus which uses ink as a fluid.

Figure 1:
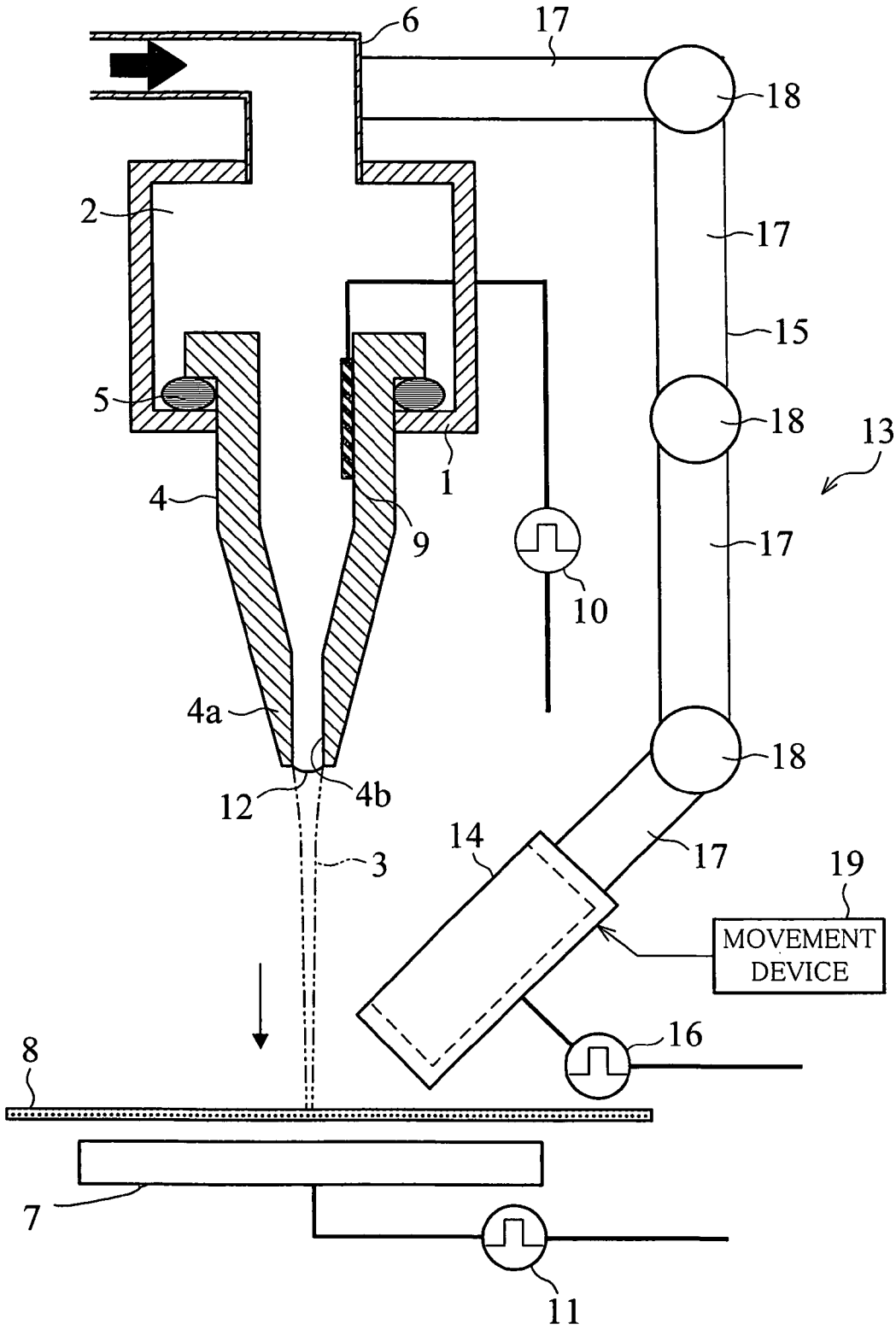
FIG. 1 is a diagram showing a schematic configuration of an ink jet apparatus of one embodiment of the present invention.

FIG. 1 is a diagram showing a schematic configuration of an ink jet apparatus of one embodiment of the present invention. As shown in FIG. 1, the ink jet apparatus includes a nozzle 4 for ejecting ink 2 that is a fluid stored in an ink chamber 1. The nozzle 4 is attached to the ink chamber 1 via a packing 5. With this, an attached portion of the nozzle 4 and the ink chamber 1 is sealed so that the ink 2 in the ink chamber 1 does not leak outwardly from this attached portion.

Moreover, the shape of the nozzle 4 is such that the internal diameter of the nozzle 4 is reduced in size toward the opposite side of the attached portion of the ink chamber 1, that is, toward a top portion 4*a* that is an ink ejection side. The internal diameter (diameter) of an ink ejecting hole 4*b* of the top portion 4*a* of the nozzle 4 is set in consideration of, for example, the diameter of the ink 2 which is ejected in the form of a thread from the nozzle 4.

To distinguish ink 2 ejected from the nozzle 4 from ink 2 stored in the ink chamber 1, the ink 2 ejected from the nozzle 4 is hereinafter referred to as ejected ink 3.

Further, inside the nozzle 4, an electrostatic field applying electrode 9 is provided to apply an electrostatic field to the ink 2. The electrostatic field applying electrode 9 is connected with a process control portion 10, and the process control portion 10 controls the intensity of an electric field generated by an applied voltage from a drive circuit (not shown). The process control portion 10 controls the intensity of the electric field, so that the amount of ejected ink 3 from the nozzle 4 is adjusted. That is, the process control portion 10 has a function of applied voltage control means for controlling a voltage applied to the ink 2 through the electrostatic field applying electrode 9.

On the opposite side of the ink ejecting hole 4*b* of the nozzle 4, a counter electrode 7 is provided at a position distanced by a certain distance from the ink ejecting hole 4*b*. The counter electrode 7 electrifies the surface of a printing medium 8, conveyed to a gap between the nozzle 4 and the counter electrode 7, at a potential whose polarity is opposite to the polarity of the potential for electrifying the ejected ink 3 from the ink ejecting hole 4*b* of the nozzle 4. With this, the ejected ink 3 from the ink ejecting hole 4*b* of the nozzle 4 stably lands on the surface of the printing medium 8. The above-described potential is supplied to the counter electrode 7 from a process control portion 11.

Thus, it is necessary that the ejected ink 3 is electrified. Therefore, it is desirable that an ink ejecting surface of, at least, the top portion 4*a* of the nozzle 4 is formed by an insulating member, and it is necessary that the internal diameter (hereinafter referred to as "nozzle diameter") of the ink ejecting hole 4*b* is minute. On this account, a glass capillary tube is used as the nozzle 4 in the present embodiment.

Therefore, in the process of the electrostatic attraction of the ink 2 (fluid), the nozzle 4 is formed to be able to form a meniscus portion 12 of the taylor cone-shaped ink 2 which is formed at the ink ejecting hole 4*b* of the nozzle 4. Moreover, the nozzle diameter of the nozzle 4 is set up to be substantially equal to the diameter of the top portion of the meniscus portion 12 of the ink which is about to be ejected.

In addition to the nozzle 4, the ink chamber 1 is connected with an ink supplying path 6 for supplying the ink 2 from an ink tank (not shown). Here, because the ink chamber 1 and the nozzle 4 are filled with the ink 2, a negative pressure is applied to the ink 2.

To enable ejection of ultra-fine fluid, a low conductance flow path is provided near the nozzle 4, or the nozzle 4 itself is a low conductance nozzle. On this account, it is preferable that the nozzle 4 be a glass capillary. However, it is possible to use as the nozzle 4 a nozzle formed by coating a conductive material with an insulating material.

The reasons why the nozzle 4 is a glass nozzle are, for example, that (i) it is easy to form a nozzle hole of several μm, (ii) when the nozzle hole is clogged, it is possible to attain a new nozzle hole by breaking an nozzle edge, (iii) since the glass nozzle is tapered, an unnecessary solution moves upward (that is, an unnecessary solution moves toward the opposite side of the nozzle hole in the case of providing the nozzle 4 so that the nozzle hole positions at the lower side) on account of the surface tension energy, and hence the solution does not remain at the nozzle edge so as not to induce the clogging of the nozzle, and (iv) since the nozzle 4 has reasonable elasticity, it is easy to form a movable nozzle.

Specifically, a glass tube with the core (product name: GD-1, made by Narishige Co., Ltd.) is used, and the nozzle can be formed by a capillary puller. The use of the glass tube with the core is advantageous for the following reasons.

(1) Since a glass on the core side is easily wettable with the ink 2, the ink 2 is easily filled up. (2) The glass on the core side is hydrophilic while the glass on the outer side is hydrophobic. For this reason, at the nozzle edge portion, the ink 2 exists only around the internal diameter of the glass on the core side, so that the concentration of the electric field is conspicuous. (3) The diameter of the nozzle can be reduced. (4) A sufficient mechanical strength can be obtained.

The lower limit of the nozzle diameter is preferably 0.01 μm in consideration of the manufacturing. The upper limit of the nozzle diameter is preferably 25 μm because the upper limit of the nozzle diameter in the case in which the electrostatic force shown in FIG. 16 exceeds the surface tension energy is 25 μm, and also the upper limit of the nozzle diameter, in the case in which the ejection conditions are met on account of the local electric field intensity shown in FIG. 17, is 25 μm. More preferably, the upper limit of the nozzle diameter is 15 μm. In particular, to effectively utilize the effect of local electric field concentration, the nozzle diameter preferably falls within the range from 0.01 μm to 8 μm.

The nozzle 4 is not necessarily a capillary tube. The nozzle 4 may be a two-dimensional-pattern nozzle formed by microfabrication. In the case in which the nozzle 4 is made of a glass with good formability, it is not possible to use the nozzle 4 as an electrode. On this account, into the nozzle 4, a metal wire (e.g. tungsten wire) is inserted as the electrostatic field applying electrode 9. Alternatively, the electrostatic field applying electrode 9 may be formed in the nozzle 4 by plating. In the case in which the nozzle 4 is made of a conductive material, the nozzle 4 is externally coated with an insulating material.

Here, the nozzle diameter of the nozzle 4 used in the present embodiment is Φ5 μm. When the nozzle diameter of the nozzle 4 is minute as above, it can be thought that a curvature radius of a meniscus top portion is substantially constant, without occurring such a phenomenon that the curvature radius of the meniscus top portion gradually decreases because of the concentration of the surface electric charge, this phenomenon having been occurred conventionally.

Therefore, in the case in which the physical-property value of the ink is constant, the surface tension energy when the ejected ink 3 is separated is substantially constant in a state in which the ejection is carried out by applying a voltage. Moreover, the amount of surface electric charge, which can be concentrated, is equal to or less than a value which exceeds the surface tension energy of the ink 2, that is, equal to or less than the value of Rayleigh split. Therefore, the maximum amount is defined uniquely.

Note that because the nozzle diameter is minute, the electric field intensity becomes very strong only in the immediate vicinity of the meniscus portion 12. Thus, the intensity of the discharge breakdown becomes very high at the high electric field in the minute region. Therefore, no problem occurs.

As the ink 2 used in the ink jet apparatus of the present embodiment, it is possible to use (i) purified water, (ii) dye-based ink and (iii) ink containing fine particles. Here, because the nozzle diameter is much smaller than the conventional ones, the particle diameter of each of the fine particles in the ink needs to be small, too. Generally, when the particle diameter is from 1/20 to 1/100 of the nozzle diameter, the nozzle is hardly clogged with the fine particles.

The ink jet apparatus of the present embodiment includes an ink catching device 13 in the vicinity of the nozzle 4. The ink catching device 13 is provided for (i) catching the denatured substance of the ink, such as a solidified substance, when the ink ejecting hole 4*b* of the nozzle 4 is clogged since the solidification or viscosity rise of the ink 2 is caused due to the drying of the ink 2, or (ii) catching the ink 2 preliminarily ejected before starting the drawing to the printing medium 8.

Specifically, to enable the formation of a fine print pattern, the nozzle 4 has the nozzle diameter of Φ5 μm that is much smaller than the conventional ones. On this account, the clogging of the ink ejecting hole 4*b* easily occurs. Therefore, in the present ink jet apparatus, the electrostatic force, which is stronger than that applied when drawing, is applied to the nozzle 4, so that the clot of the ink 2 clogged in the ink ejecting hole 4*b* is ejected, and caught by the ink catching device 13.

The ink catching device 13 includes an ink catching portion 14, a supporting portion 15 for supporting the ink catching portion 14 at a position adjacent to the nozzle 4, a process control portion 16, etc.

The ink catching portion 14 is connected with the process control portion 16, and the process control portion 16 controls the intensity of an electric field generated by an applied voltage from a drive circuit (not shown). The process control portion 16 controls this electric field, so that the catching portion 14 can catch by using electrostatic attraction the ejected ink 3 from the nozzle 4 and the denatured substance of the ink, such as the clot of the ink which is solidified or increased in viscosity due to the drying of the ink. That is, the process control portion 16 has a function of applied voltage control means for controlling a voltage applied to the ink catching portion 14.

The supporting portion 15 is configured such that a plurality of supporting members 17 are connected with each other via moving portions 18. Therefore, by rotation operations, centering on the moving portions 18, of the supporting members 17, the ink catching portion 14 supported by the supporting portion 15 can move between (i) a catching position for catching the ejected ink 3 from the nozzle 4 and (ii) an escaped position escaped from the catching position, as shown in FIG. 1. The ink catching portion 14 is moved by a movement device 19 for causing the ink catching portion 14 to move. That is, the movement device 19 causes the ink catching portion 14 to move and controls the relative position of the ink catching portion 14 with respect to the nozzle 4.

Note that the supporting portion 15 is so configured as to support the nozzle 4 and the ink catching portion 14 and as to be movable with respect to the counter electrode 7. In this case, by moving the supporting portion 15 driven by supporting portion moving means (not shown), the drawing can be carried out with respect to the printing medium 8 fixed to the counter electrode 7, by using the ink 2 ejected from the nozzle 4.

In the present embodiment, the ink catching portion 14 is made of a conductive metal material, such as Cu, Al, or SUS, and is in the form of a container whose surface facing the nozzle 4 is open. Specifically, the ink catching portion 14 is, for example, in the form of a cylindrical container having the external diameter of 500 μm, the internal diameter of 400 μm, and the thickness of 150 μm.

Figure 2:
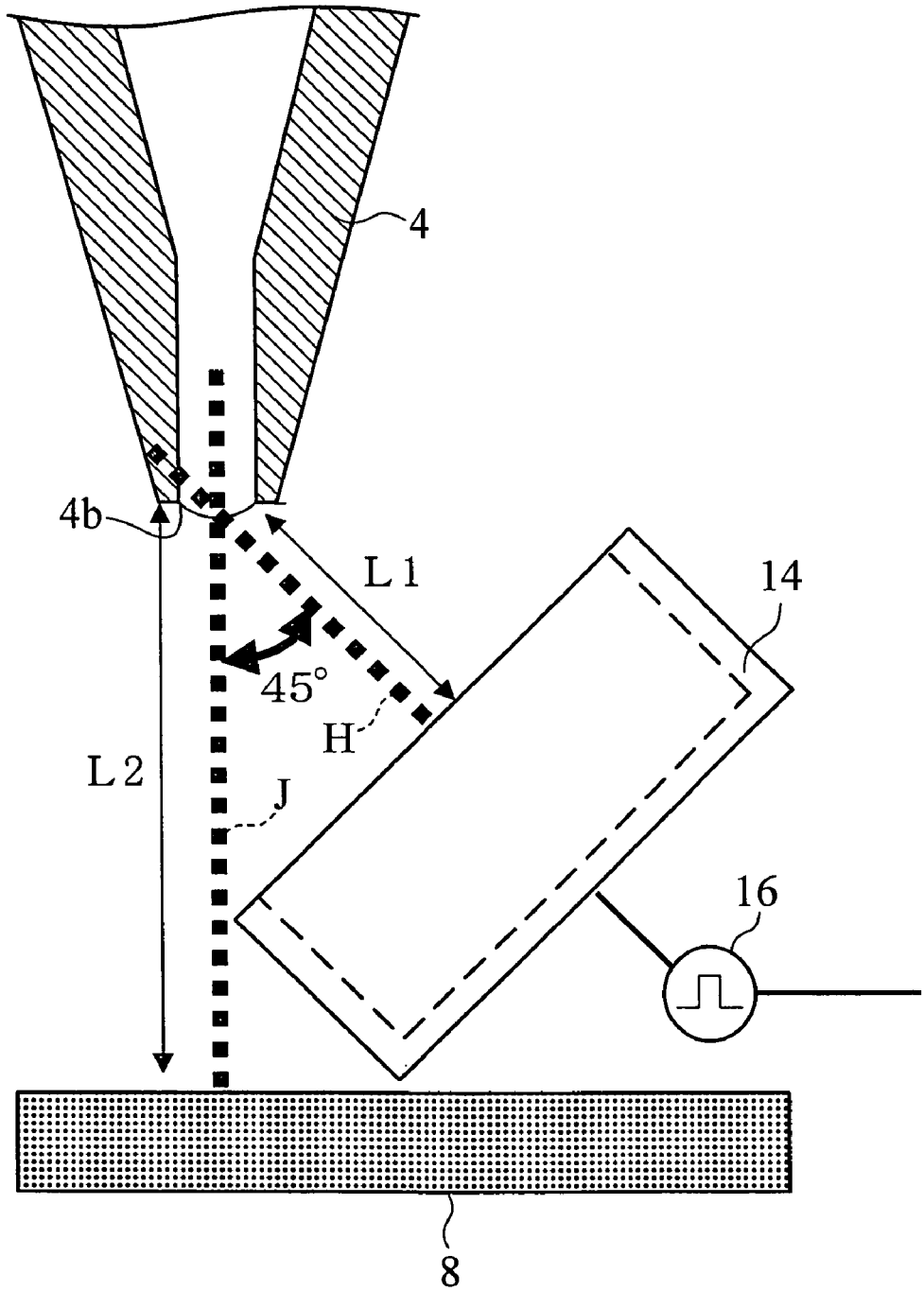
FIG. 2 is an explanatory diagram of a catching position of an ink catching portion shown in FIG. 1.

At the catching position shown in FIG. 1, the ink catching portion 14 in the form of a cylindrical container is provided so that, as shown in FIG. 2, a normal line H passing through the center of the cylindrical container passes through the ink ejecting hole 4*b* of the nozzle 4. Specifically, a distance L1 between the ink ejecting hole 4*b* of the nozzle 4 and the ink catching portion 14 is 300 μm, a distance L2 between the ink ejecting hole 4*b* and the printing medium 8 is 500 μm, and an angle between the normal line H passing through the center of the ink catching portion 14 and a central axis J of the ink ejecting hole 4*b* is 45 degrees.

Moreover, in FIG. 2, it is preferable that the ink catching portion 14 be provide at a position which satisfies L<L2, where L indicates the distance between (i) a portion of the ink catching portion 14, the portion being furthest from the ink ejecting hole 4*b* and (ii) the ink ejecting hole 4*b*, and L2 indicates the distance between the ink ejecting hole 4*b* of the nozzle 4 and the printing medium 8.

With this setting, the efficiency of attracting the ink by the ink catching portion 14 can be high, and the ink catching portion 14 can catch all the denatured substances of the ink removed from the ink ejecting hole 4*b* of the nozzle 4, so that the denatured substances do not fly in a direction of the printing medium 8.

Note that in the example of FIG. 2, the angle between the normal line H passing through the center of the ink catching portion 14 and the central axis J of the ink ejecting hole 4*b* is 45 degrees. However, by setting the catching position of the ink catching portion 14 so that L<L2 is satisfied, it is possible to prevent a mechanical contact between the ink catching portion 14 and a head unit component, such as the nozzle 4, the printing medium 8, or the supporting portion 15. Of course, the catching position of the ink catching portion 14 is such a position that the drawing operation with respect to the printing medium 8 is not disturbed.

The following will explain a maintenance operation, drawing operation and preliminary ejection operation of the nozzle 4 of the present ink jet apparatus.

Figure 3:
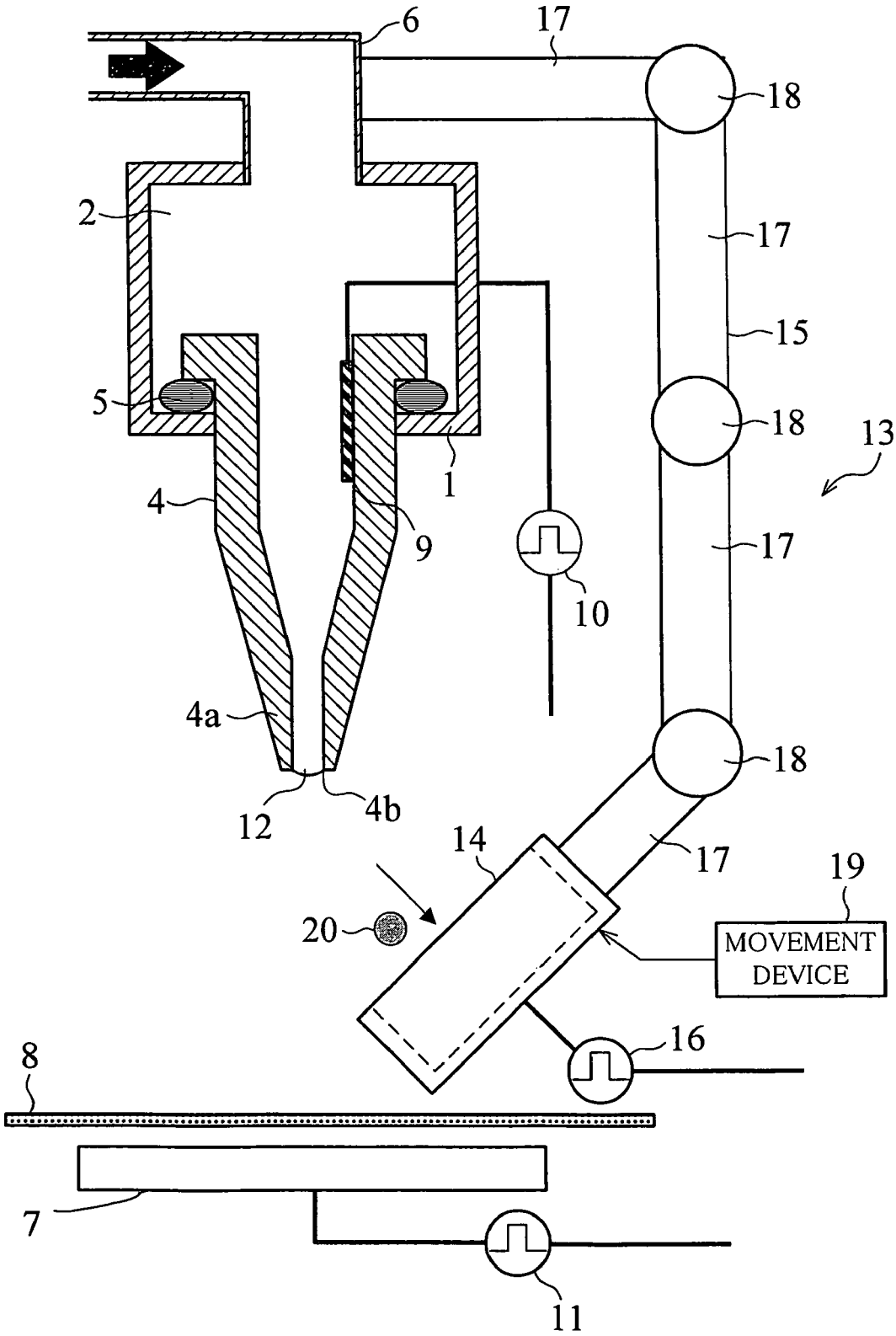
FIG. 3 is a diagram showing a schematic configuration of the ink jet apparatus, shown in FIG. 1, which is carrying out a maintenance operation for a nozzle.

In the present ink jet apparatus, when the denatured substance of the ink is formed at the top portion (ink ejecting hole 4*b*, for example) of the nozzle 4 or inside the nozzle 4 by the drying or increase in viscosity of the ink 2, the denatured substance is removed to carry out satisfactory ejection from the nozzle 4. FIG. 3 is a diagram showing a schematic configuration of the ink jet apparatus which is carrying out the maintenance operation. In this case, the positional relation between the nozzle 4 and the ink catching portion 14 is shown in FIG. 1, that is, the ink catching portion 14 is provided at the catching position.

Like the drawing operation, the attraction by the electric field is used in the maintenance operation. That is, in the drawing operation, the electric field for attracting the ink 2 in a direction of the counter electrode 7 is generated between the nozzle 4 and the counter electrode 7, while in the maintenance operation, the electric field for attracting an ink denatured substance 20 (see FIG. 3) in a direction of the ink catching portion 14 is generated between the nozzle 4 and the ink catching portion 14. Moreover, the intensity of the electric field used in the maintenance operation needs to be stronger than that used in the drawing operation because the maintenance operation is carried out to remove the ink denatured substance 20 from the nozzle 4 and causes the ink catching portion 14 to catch the ink denatured substance 20 thus removed.

FIG. 4 shows an example of relations of potentials of portions (applied voltages to respective portions) in the maintenance operation. Note that FIG. 4 also shows relations of potentials of portions in the preliminary ejection operation and the drawing operation.

The following will explain one example in reference to FIG. 4. The process control portion 10 applies a voltage of 1,000 V as an electrostatic field applying voltage to the electrostatic field applying electrode 9 of the nozzle 4, and the process control portion 16 applies a voltage of −500 V to the ink catching portion 14. With this, an electric field for removing the ink denatured substance 20 from the nozzle 4 and causing the ink catching portion 14 to attract the ink denatured substance 20 so as to catch it is generated between the nozzle 4 and the ink catching portion 14. That is, most of electric flux lines generated from the top portion of the nozzle 4 reach the ink catching portion 14, the ink denatured substance 20 aggregated inside the nozzle 4 as a cause of the clogging is ejected from the nozzle 4 by a potential difference between the above-described voltages, and the ink denatured substance 20 reaches the ink catching portion 14 as the ink denatured substance 20 is increased in speed along the electric flux lines.

The ink denatured substance 20 which has reached the ink catching portion 14 directly reaches a bottom surface of the ink catching portion 14 or reaches the bottom surface of the ink catching portion 14 by flowing on an inner wall surface of the ink catching portion 14, and is stored in the ink catching portion 14. In this case, if the ink denatured substance 20 is not solidified yet, it is solidified here.

Moreover, to allow the ink catching portion 14 to easily catch the ink denatured substance 20 in the maintenance operation, it is preferable that the applied voltage to the counter electrode 7 be set to have the same polarity as the voltage (500 V, for example) of the electrostatic field applying electrode 9, to be 0 V, or to be in a range from 0 V to 500 V.

In the case in which the voltage having the same polarity as the voltage of the electrostatic field applying electrode 9 is applied to the counter electrode 7, the electric flux line(s) from the top of the nozzle 4 does not intersect with the printing medium 8. Therefore, the ink denatured substance 20 is not attracted in a direction of the counter electrode 7. On this account, the ink denatured substance 20 does not adhere to the printing medium 8, and is surely caught by the ink catching portion 14.

FIG. 4 shows other examples of the combination of the applied voltages to the electrostatic field applying electrode 9, the counter electrode 7 and the ink catching portion 14 in the maintenance operation.

The following will explain the preliminary ejection operation of the present ink jet apparatus.

The present ink jet apparatus carries out the preliminary ejection operation (i) before starting drawing, (ii) after the maintenance operation and before starting drawing or (iii) after the amount of ink 2 ejected from the nozzle 4 is adjusted and before starting drawing. The preliminary ejection operation is carried out for preventing the ejection of the ink 2 from being unstable at the beginning of the ejection of the ink 2 in the drawing operation.

In the preliminary ejection operation, the position of the ink catching portion 14 with respect to the nozzle 4 is the catching position shown in FIGS. 1 and 3, and the electric field for causing the ink 2 to be ejected from the nozzle 4 and attracting the ejected ink 3 by the ink catching portion 14 is generated between the nozzle 4 and the ink catching portion 14. The direction of the electric field in this case is the same as that in the maintenance operation, but the intensity of the electric field in this case may be lower than that in the maintenance operation.

The following will explain one example in reference to FIG. 4. The process control portion 10 applies a voltage of 250 V as the electrostatic field applying voltage to the electrostatic field applying electrode 9 of the nozzle 4, and the process control portion 16 applies a voltage of −50 V to the ink catching portion 14. With this, the electric field for causing the ink 2 to be ejected from the nozzle 4 and attracting the ejected ink 3 by the ink catching portion 14 so as to catch it is generated between the nozzle 4 and the ink catching portion 14.

Like FIG. 1, by this electric field, the ink 2 is ejected in the form of a thread from the nozzle 4, and is attracted by the ink catching portion 14. The ink 2 which has reached the ink catching portion 14 directly reaches the bottom surface of the ink catching portion 14 or reaches the bottom surface of the ink catching portion 14 by flowing on the inner wall surface of the ink catching portion 14, is stored in the ink catching portion 14, and is solidified.

Moreover, to allow the ink catching portion 14 to easily catch the ejected ink 3 from the nozzle 4 in the preliminary ejection operation, it is preferable that the applied voltage to the counter electrode 7 be set to have the same polarity as the voltage (50 V, for example) of the electrostatic field applying electrode 9, to be 0 V, or to be in a range from 0 V to 50 V.

In the case in which the voltage having the same polarity as the voltage of the electrostatic field applying electrode 9 is applied to the counter electrode 7, the electric flux line(s) from the top of the nozzle 4 does not intersect with the printing medium 8. Therefore, the ejected ink 3 is not attracted in a direction of the counter electrode 7. On this account, the ejected ink 3 does not adhere to the printing medium 8, and is surely caught by the ink catching portion 14.

FIG. 4 shows other examples of the combination of the applied voltages to the electrostatic field applying electrode 9, the counter electrode 7 and the ink catching portion 14 in the preliminary ejection operation.

As above, by carrying out the preliminary ejection operation before the drawing operation, it is possible to prevent an unstable ejection of ink at the beginning of the ejection in the drawing operation, and also possible to improve resolution. In the present embodiment, the preliminary ejection operation is carried out for a predetermined period of time, and is, for example, one second. This preliminary ejection period can be suitably changed in accordance with a characteristic of a drawing system.

The following will explain the drawing operation with respect to the printing medium 8 in the present ink jet apparatus. In the drawing operation, the position of the ink catching portion 14 with respect to the nozzle 4 is the catching position shown in FIG. 1, and the electric field for causing the ink 2 to be ejected from the nozzle 4 and attracting the ejected ink 3 in a direction of the counter electrode 7 is generated between the nozzle 4 and the counter electrode 7.

The following will explain one example in reference to FIG. 4. The process control portion 10 applies a voltage of 150 V as the electrostatic field applying voltage to the electrostatic field applying electrode 9 of the nozzle 4, and the process control portion 11 applies a voltage of −50 V to the counter electrode 7. With this, the ink 2 from the ink ejecting hole **4*b* of the nozzle 4 is in the form of a thread and reaches the printing medium 8, and the drawing by the ejected ink 3 is carried out with respect to the printing medium 8**.

Moreover, not to generate the electric field, between the nozzle 4 and the ink catching portion 14, for attracting the ejected ink 3 from the nozzle 4 in the drawing operation, it is preferable that the applied voltage to the ink catching portion 14 be set to have the same polarity as the voltage (50 V, for example) of the electrostatic field applying electrode 9, to be 0 V, or to be in a range from 0 V to 50 V.

In the case in which the voltage having the same polarity as the voltage of the electrostatic field applying electrode 9 is applied to the ink catching portion 14, the ejected ink 3 from the nozzle 4 is not attracted in a direction of the ink catching portion 14, and the ejected ink 3 surely reaches the printing medium 8 that is in front of the counter electrode 7. FIG. 4 shows other examples of the combination of the applied voltages to the electrostatic field applying electrode 9, the counter electrode 7 and the ink catching portion 14 in the drawing operation.

Note that it is preferable that switching, from the preliminary operation to the drawing operation, of the applied voltages to respective electrodes be carried out simultaneously.

In addition, FIG. 4 shows electric potentials and polarities of respective electrodes in the maintenance operation, the drawing operation and the preliminary ejection operation. In FIG. 4, each voltage is just an example, and is not limited to this. Further, each voltage may be used as a standard, and may be adjusted suitably so that the respective operations are carried out satisfactorily.

Figure 5:
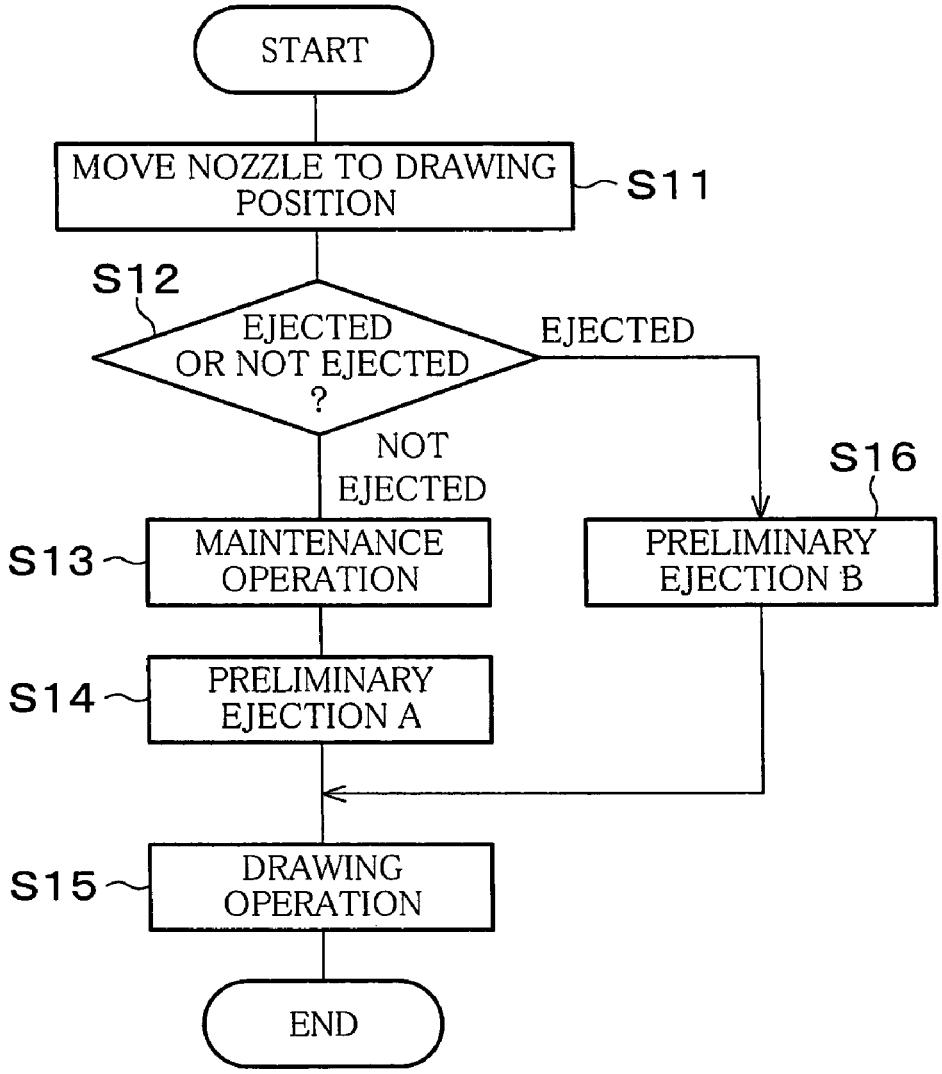
FIG. 5 is a flow chart showing a series of steps, until a drawing operation, carried out by the ink jet apparatus shown in FIG. 1.

Referring to the flow cart shown in FIG. 5, the following will explain a series of operations including the maintenance operation, the preliminary ejection operation and the drawing operation in the ink jet apparatus.

In the case of carrying out the drawing operation, the nozzle 4 is moved to a drawing position above the printing medium 8 provided on or above the counter electrode 7 (S11).

Next, whether the ejection from the nozzle 4 can be carried out or not is judged (S12). If the ejection cannot be carried out, the maintenance operation is carried out (S13). Meanwhile, if the ejection can be carried out, the preliminary ejection operation (preliminary ejection B) is carried out (S16).

Note that whether the ejection can be carried out or not is judged in the following manner: The preliminary ejection is actually carried out with respect to the ink catching portion 14, and whether or not the ink 2 is ejected to the ink catching portion 14 is confirmed by an optical detection system using a laser. In this case, whether the ejection is carried out or not is detected in the following manner: The laser is irradiated in the vicinity of the top portion of the nozzle 4, and whether or not there is reflected light from an ejected substance from the nozzle 4 is detected by a photoelectric converting device. This technique is used by a normal ink jet apparatus.

The maintenance operation in S13 is carried out as above. In this case, the ink catching portion 14 is provided at the catching position.

After the maintenance operation, the ink jet apparatus carries out the above-described preliminary ejection operation (preliminary ejection A) for, for example, a predetermined period of time (S14). In this preliminary ejection operation, the applied voltages, shown in FIG. 4, to respective portions may be adjusted suitably.

After the preliminary ejection operation, the applied voltages to respective portions are switched to the voltages for the drawing operation shown in FIG. 4. Then, the drawing operation is carried out (S15). After the drawing operation, the ink jet apparatus finishes operating.

Meanwhile, the preliminary ejection operation (preliminary ejection B) in S16 is carried out in the above manner. Note that unlike the preliminary ejection operation (preliminary ejection A), the operation of providing the ink catching portion 14 at the catching position is necessary in this preliminary ejection operation (preliminary ejection B) if the ink catching portion 14 is not provided at the catching position. Other steps in the preliminary ejection B is the same as those in the preliminary ejection A. After the preliminary ejection in S16, the process proceeds to S15, and the drawing operation is carried out.

Note that in the above embodiment, the shape of the ink catching portion 14 is not limited to a cylindrical container, and may be any container. Further, the shape of the ink catching portion 14 is not necessarily a container, but may be, for example, a flat plate.

Moreover, in the present embodiment, the ink catching portion 14 is so configured as to be movable, by the supporting portion 15, between the catching position and the escaped position escaped from the catching position. However, the ink catching portion 14 may be configured so that the position thereof is fixed to a certain catching position.

Embodiment 2

The following will explain another embodiment of the present invention in reference to the figures. Note that explanations of the same members as the above embodiment are omitted here.

Figure 6:
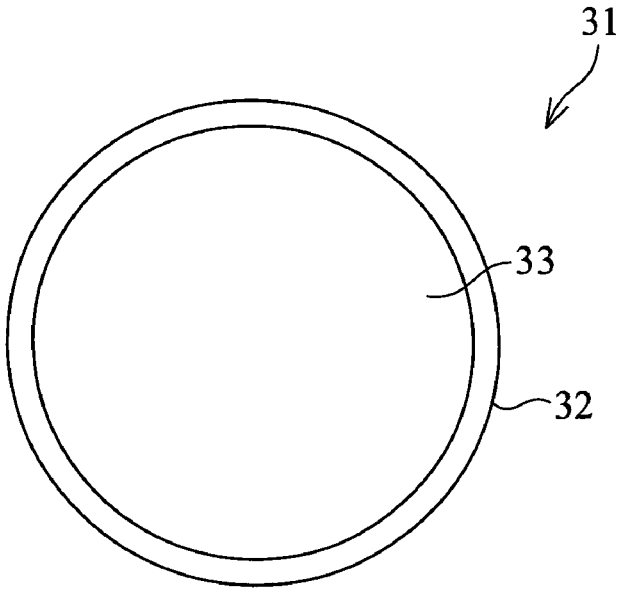
FIG. 6(*a*) is a plan view showing another example of the ink catching portion shown in FIG. 1, and FIG. 6(*b*) is a longitudinal sectional view showing the same.
Figure 6:
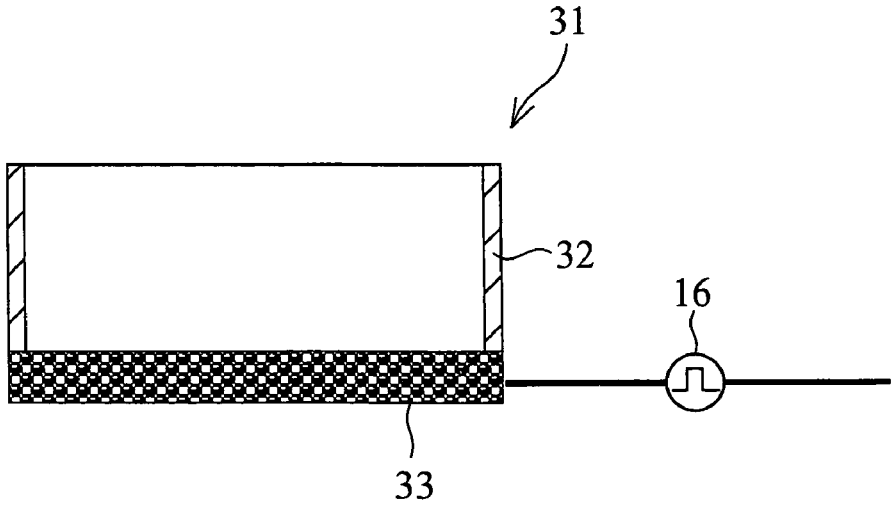

Instead of the ink catching portion 14, an ink jet apparatus of the present embodiment includes an ink catching portion 31 shown in FIGS. 6(*a*) and 6(*b*). FIG. 6(*a*) is a plan view of the ink catching portion 31, and FIG. 6(*b*) is a longitudinal sectional view of the ink catching portion 31.

The external form and size of the ink catching portion 31 is substantially the same as, for example, those of the ink catching portion 14. The ink catching portion 31 includes, for example, a container portion 32 that is in the form of a cylindrical container, and an attraction electrode portion 33. The attraction electrode portion 33 is connected with the process control portion 16.

The container portion 32 is made of a low dielectric material, such as organic resin, glass, or silica. The attraction electrode portion 33 is made of a conductive material, and is provided at a bottom wall portion of the container portion 32.

Since the container portion 32 of the ink catching portion 31 configured as above is made of the low dielectric material, the electric flux line(s) generated from the top of the nozzle 4 in the maintenance operation reaches not the container portion 32 but the attraction electrode portion 33 made of the conductive material. Therefore, the ink denatured substance 20 flown from the nozzle 4 in the maintenance operation or the ejected ink 3 from the nozzle 4 in the preliminary ejection operation does not adhere to the container portion 32 but adhere to an upper surface of the attraction electrode portion 33 in the container portion 32.

With this, it is possible to prevent the following problem: The drawing operation by the ink jet apparatus becomes unstable since the ink denatured substance 20 or the ejected ink 3 adheres to an external portion of the ink catching portion 31 and the adhered substance interferes with the nozzle 4 or other component(s) of the drawing system including the ink jet apparatus.

Further, since the ink denatured substance 20 and the ejected ink 3 can be surely caught in the inside of the container portion 32 of the ink catching portion 31, (i) it is possible to prevent such a problem that, after the ink denatured substance 20 or the ejected ink 3 adheres to the container portion 32, the adhered substance is separated from the container 32 and falls onto, for example, the printing medium 8, and (ii) the printing medium 8 and the components of the drawing system are not defaced by the adherence of the ink denatured substance 20 or the ejected ink 3.

Embodiment 3

The following will explain still another embodiment of the present invention in reference to the figures. Note that explanations of the same members as the above embodiments are omitted here.

Figure 7:
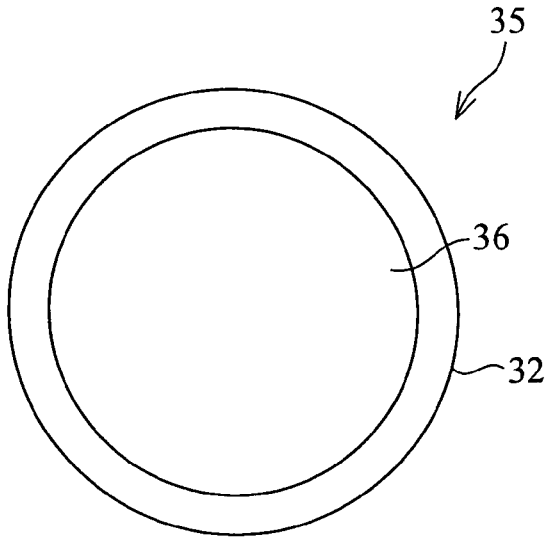
FIG. 7(*a*) is a plan view showing still another example of the ink catching portion shown in FIG. 1, and FIG. 7(*b*) is a longitudinal sectional view showing the same.
Figure 7:
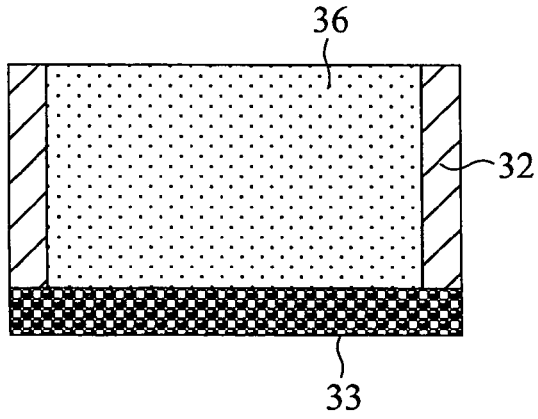
Figure 8:
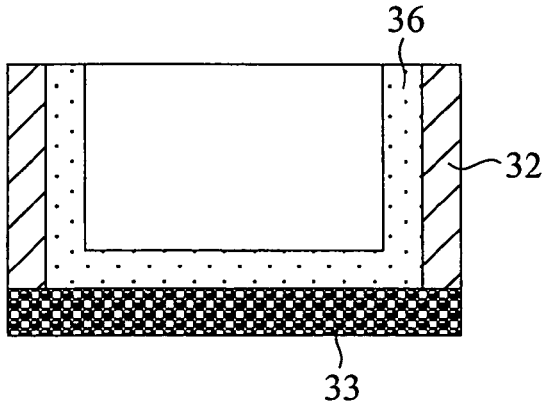
FIG. 8 is a longitudinal sectional view showing another example of the ink catching portion shown in FIG. 7(*b*).

Instead of the ink catching portion 14, an ink jet apparatus of the present embodiment includes an ink catching portion 35 shown in FIGS. 7(*a*) and 7(*b*). FIG. 7(*a*) is a plan view of the ink catching portion 35, and FIG. 7(*b*) is a longitudinal sectional view of the ink catching portion 35. FIG. 8 is a longitudinal sectional view showing another example of a configuration of the ink catching portion 35.

The ink catching portion 35 includes the container portion 32 and attraction electrode portion 33 which are similar to those in the ink catching portion 31, and the container portion 32 here includes therein an absorber 36 made of an insulating material. Note that the attraction electrode portion 33 is connected with the process control portion 16.

The absorber 36 is so formed as to be the same in size as an inner space of the container portion 32, and has absorbability with respect to a substance caught by the ink catching portion 35. Note that the absorber 36 may be in the form of a container as shown in FIG. 8.

In the present embodiment, used as the absorber 36 is a porous body made of a low dielectric material in the form of a cylinder (a cylindrical container in FIG. 8) having the diameter of 400 μm and the thickness of 100 μm, and used as the attraction electrode portion 33 is a conductive material in the form of a circular plate having the diameter of 400 μm and the thickness of 50 μm.

Moreover, the absorber 36 is not limited to the porous body, and it is possible to obtain the same functions even if the absorber 36 is a fibriform material.

Moreover, used as the absorber 36 may be a conductive material, such as steel wool. In this case, a conductive portion (absorber 36) in the ink catching portion 35 and the top portion of the nozzle 4 are satisfactorily opposed to each other, and the electric flux line(s) from the nozzle 4 reaches a countering surface, with respect to the nozzle 4, of the ink catching portion 35 (countering surface, with respect to the nozzle 4, of the absorber 36). With this, the above-described caught substance ejected from the nozzle 4 reaches the counter surface, that is, it is possible to prevent the adherence of the caught substance with respect to a side surface of the ink catching portion 35. On this account, it is possible to further improve the stability of absorption of the caught substance by the absorber 36.

As above, in the ink catching portion 35 including the absorber 36, it is possible to prevent the damage or defacement of the container portion 32 or the attraction electrode portion 33, the damage or defacement being caused by the collision of the caught substance, such as the ink denatured substance 20 or ejected ink 3 ejected from the nozzle 4 in the maintenance operation or the preliminary ejection operation, with the container portion 32 or the attraction electrode portion 33. Further, it is possible to prevent droplets of the caught substance from flying outside the ink catching portion 35.

Moreover, the caught substance caught by the ink catching portion 35 is promptly absorbed by the absorber 36. Therefore, it is possible to further improve a function of preventing the caught substance adhered to the container portion 32 from being removed from the container portion 32 and falling onto, for example, the printing medium 8.

Moreover, the ink catching portion 35 may be configured such that part of the inner wall thereof is covered with the absorber 36. Again, it is possible to obtain the above-described respective functions by the absorber 36.

Embodiment 4

The following will explain yet another embodiment of the present invention in reference to the figures. Note that explanations of the same members as the above embodiments are omitted here.

Figure 9:
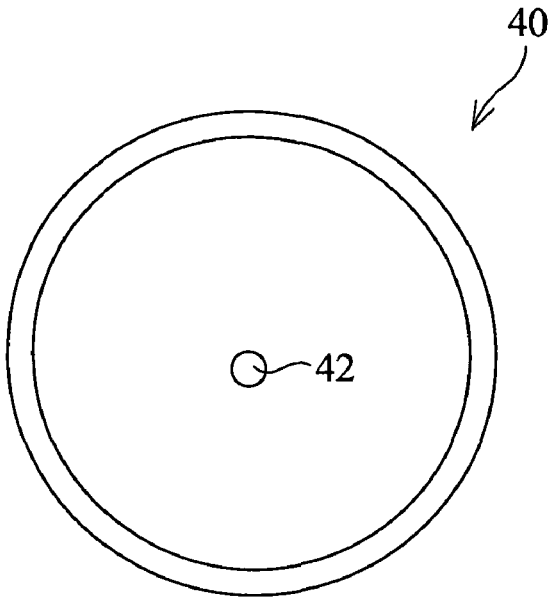
FIG. 9(*a*) is a plan view showing yet another example of the ink catching portion shown in FIG. 1, and FIG. 9(*b*) is a longitudinal sectional view showing the same.
Figure 9:
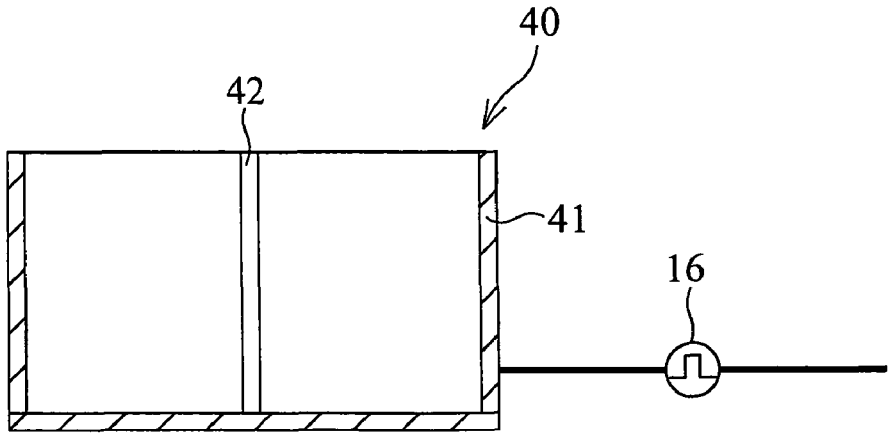

Instead of the ink catching portion 14, an ink jet apparatus of the present embodiment includes an ink catching portion 40 shown in FIGS. 9(*a*) and 9(*b*). FIG. 9(*a*) is a plan view of the ink catching portion 40, and FIG. 9(*b*) is a longitudinal sectional view of the ink catching portion 40.

The ink catching portion 40 includes (i) a container portion 41 which is in the form of a cylindrical container and is made of a low dielectric material, such as organic resin, glass or silica, and (ii) a conductive attraction electrode portion 42 which is provided at, for example, the center inside the container portion 41 and is in the form of a bar standing on the bottom surface of the container portion 41 in a vertical direction. The container portion 41 is connected with the process control portion 16.

In the present embodiment, the container portion 41 is in the form of a cylindrical container having the external diameter of 500 μm, the internal diameter of 400 μm and the thickness of 150 μm, and the attraction electrode portion 42 is in the form of a cylinder having the diameter of 50 μm and the length of 100 μm.

In the present ink jet apparatus, the container portion 41 of the ink catching portion 40 is made of a low dielectric material. Therefore, in the maintenance operation and the preliminary ejection operation, the electric flux line(s) generated from the top of the nozzle 4 reaches the top portion of the attraction electrode portion 42 made of a conductive material. On this account, the ink denatured substance 20 or ejected ink 3 ejected from the nozzle 4, that is, the caught substance caught by the ink catching portion 40 adheres to the attraction electrode portion 42.

With this, according to the configuration including the ink catching portion 40, it is possible to prevent the following problem: The drawing operation by the ink jet apparatus becomes unstable since the caught substance adheres to an external portion of the ink catching portion 40 and the adhered substance interferes with the nozzle 4 or other component(s) of the drawing system including the ink jet apparatus.

Further, since the caught substance can be surely caught in the inside of the container portion 41 of the ink catching portion 40, (i) it is possible to prevent such a problem that, after the caught substance adheres to the container portion 41, the adhered substance is separated from the container portion 41 and falls onto, for example, the printing medium 8, and (ii) the printing medium 8 and the components of the drawing system are not defaced by the adherence of the ink denatured substance 20 or the ejected ink 3.

Moreover, the caught substance caught by the ink catching portion 40 adheres to the attraction electrode portion 42. Therefore, it is possible to prevent the damage or defacement of the inner wall of the container portion 41, the damage or defacement being caused by the collision of the caught substance with the inner wall of the container portion 41.

In the present embodiment, the sizes of the container portion 41 and attraction electrode portion 42 of the ink catching portion 40 are described above as one example. However, as long as the ink catching portion 40 has therein a space for storing the caught substance and the ink catching portion 40 does not mechanically interfere with the other components of the apparatus, the above-described functions can be obtained regardless of the shape, size and position of each portion and the number of the attraction electrode portions 42.

Moreover, in the present embodiment, by acuminating the top portion of the attraction electrode portion 42 (which is in the form of a bar) of the ink catching portion 40, it is possible to strengthen the concentration of the electric field at the top portion of the attraction electrode portion 42. With this, it is possible to further improve a function of causing the caught substance to adhere to the top portion of the attraction electrode portion 42.

Further, it is preferable that the attraction electrode portion 42 be replaceable. In this configuration, if the power of attraction of the attraction electrode portion 42 is reduced due to the damage or deformation thereof caused by the collision of the caught substance and the attraction electrode portion 42, it is possible to recover the power of attraction by replacing the damaged attraction electrode portion 42 with the new one.

Embodiment 5

The following will explain still another embodiment of the present invention in reference to the figures. Note that explanations of the same members as the above embodiments are omitted here.

An ink jet apparatus of the present embodiment includes, for example, the ink catching portion 14, and is configured so as to cause the ink catching portion 14 to move between the escaped position and the catching position by the movement device 19 in accordance with the drawing operation, the maintenance operation and the preliminary ejection operation.

Figure 10:
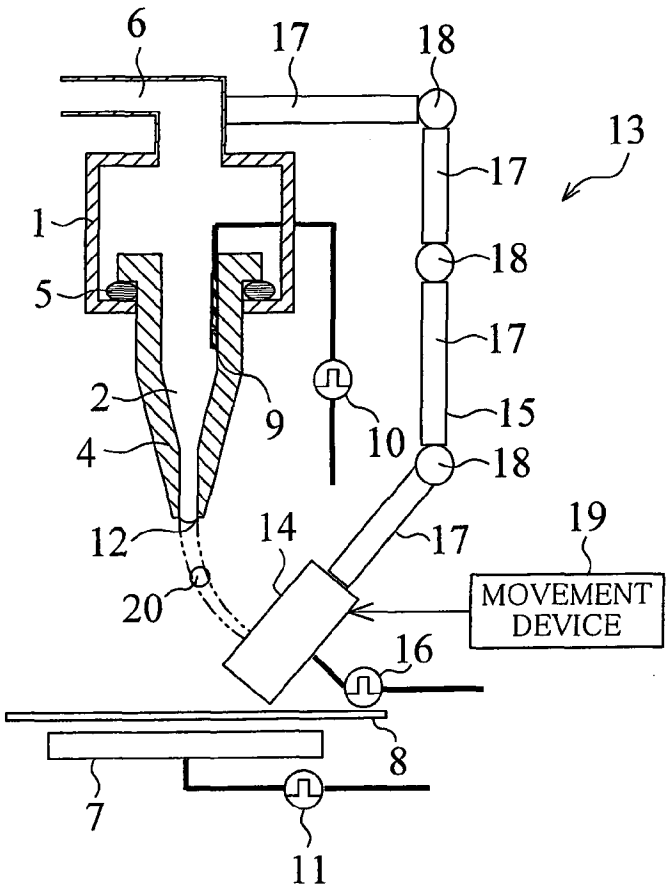
FIG. 10(*a*) is an explanatory diagram showing a state in which the ink catching portion is provided at an escaped position in the drawing operation of the ink jet apparatus shown in FIG. 1, and FIG. 10(*b*) is an explanatory diagram showing a state in which the ink catching portion is provided at the catching position in the maintenance operation and the preliminary ejection operation of the ink jet apparatus shown in FIG. 1.
Figure 10:
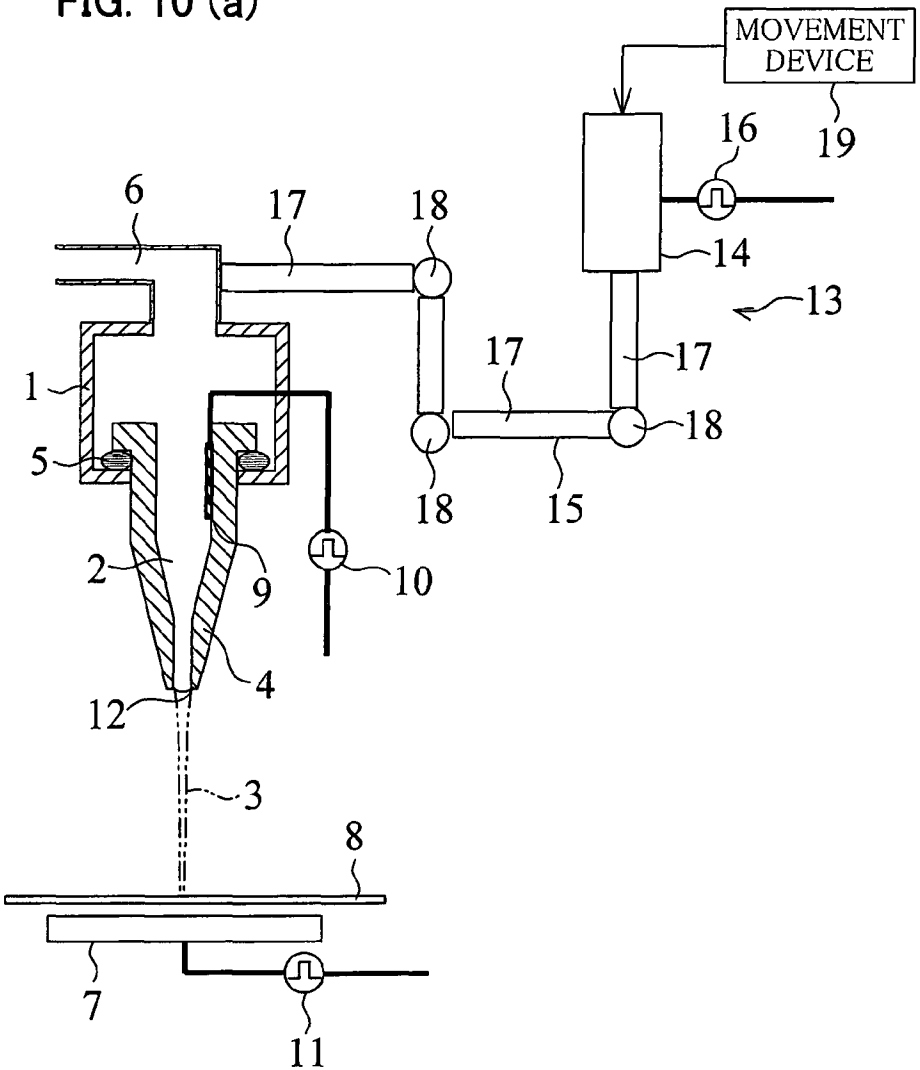

FIG. 10(*a*) is a diagram showing a configuration of the ink jet apparatus in the drawing operation, and FIG. 10(*b*) is a diagram showing a configuration of the ink jet apparatus in the maintenance operation and the preliminary ejection operation.

That is, since the ink catching portion 14 is not used in the drawing operation, it is provided at the escaped position distanced from the nozzle 4, as shown in FIG. 10(*a*). With this, the ejected ink 3 from the nozzle 4 appropriately reaches the printing medium 8 without being affected electrostatically by the ink catching portion 14 and without the interference with the ink catching portion 14.

Meanwhile, since the ink catching portion 14 is used in the maintenance operation and the preliminary ejection operation, it is provided at the predetermined catching position adjacent to the nozzle 4, as shown in FIG. 10(*b*). With this, the ink denatured substance 20 and the ejected ink 3 can be appropriately caught by the ink catching portion 14 in the maintenance operation and the preliminary ejection operation.

Embodiment 6

The following will explain yet another embodiment of the present invention in reference to the figures. Note that explanations of the same members as the above embodiments are omitted here.

Figure 11:
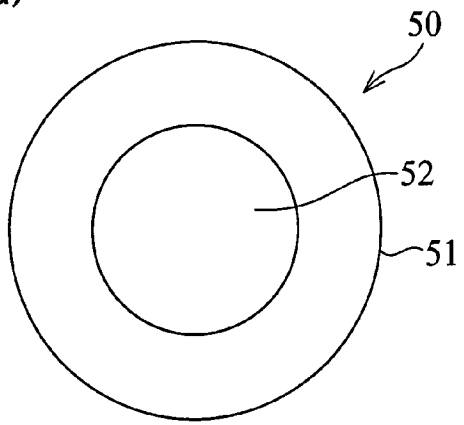
FIG. 11(*a*) is a plan view showing still another example of the ink catching portion shown in FIG. 1, FIG. 11(*b*) is a bottom view showing the same, FIG. 11(*c*) is a longitudinal sectional view showing the same, and FIG. 11(*d*) is a side view showing the same.
Figure 11:
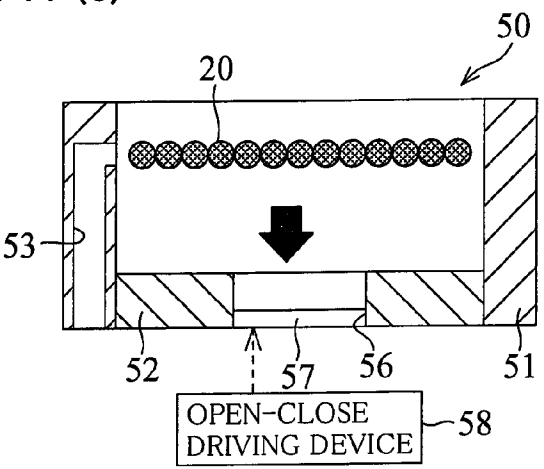
Figure 11:
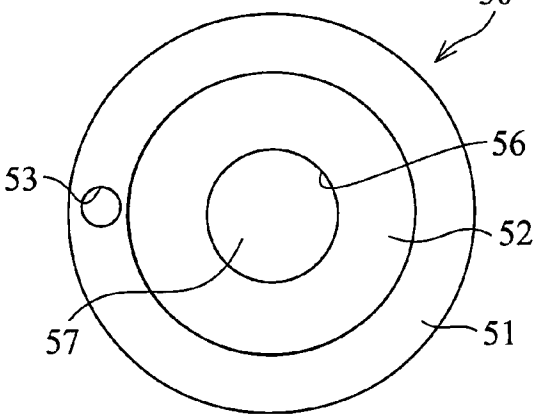
Figure 11:
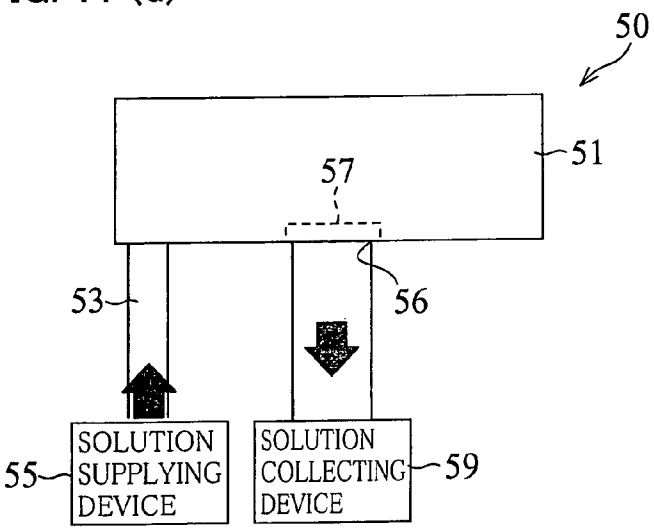

Instead of the ink catching portion 14, an ink jet apparatus of the present embodiment includes an ink catching portion 50 shown in FIGS. 11(*a*) to 11(*d*). FIG. 11(*a*) is a plan view of the ink catching portion 50, FIG. 11(*b*) is a bottom view of the ink catching portion 50, FIG. 11(*c*) is a longitudinal sectional view of the ink catching portion 50, and FIG. 11(*d*) is a side view of the ink catching portion 50.

The ink catching portion 50 includes, for example, (i) a container portion 51 that is in the form of a cylinder and (ii) an attraction electrode portion 52 that is a bottom wall portion of the container portion 51. The container portion 51 is made of the same low dielectric material as the container portion 32, and the attraction electrode portion 52 is made of the same conductive material as the attraction electrode portion 33.

Inside a side wall of the container portion 51, a flow path 53 is formed. The flow path 53 extends in an axial direction of the container portion 51 that is in the form of a cylinder. Moreover, one end of the flow path 53 opens at a bottom surface of the side wall, and another end of the flow path 53 opens, for example, at an upper position of the side surface of the side wall, that is, toward the inside of the container portion 51.

The above-described one end of the flow path 53 is connected with a solution supplying device 55, and the solution supplying device 55 injects a solution (solvent) 54 to the ink catching portion 50 through the flow path 53. The solution 54 can dissolve the ink denatured substance 20 which is caught by the ink catching portion 50 and is solidified.

In addition, as shown in FIG. 11(*c*), a discharging opening 56 is formed at the bottom wall portion of the ink catching portion 50, and an open-close portion 57 is provided with respect to the discharging opening 56. Operations of opening and closing the discharging opening 56 by the open-close portion 57 are carried out by an open-close driving device 58.

The solution 54 injected from the above-described one end of the flow path 53 is ejected from the above-described another end of the flow path 53 to the inside of the ink catching portion 50. The solution 54 reaches the bottom surface of the ink catching portion 50 by flowing on an inner surface of the side wall of the ink catching portion 50, and is stored in the ink catching portion 50. The solution 54 dissolves the caught substance caught in the ink catching portion 50.

The amount of the solution 54 injected into the ink catching portion 50 is controlled by the solution supplying device 55. When the amount of the solution 54 injected reaches a predetermined amount, the open-close driving device 58 controlled by the solution supplying device 55 opens the open-close portion 57, and the solution 54 is discharged from the discharging opening 56. The discharged solution 54 is collected by a solution collecting device 59 connected with the discharging opening 56. With this, the inside of the ink catching portion 50 is appropriately washed by the solution 54, and it is possible to accordingly discharge the caught substance in the ink catching portion 50.

Note that it is desirable that the solution 54 has a solvent component contained in the ink 2.

The following will explain a method for manufacturing the ink catching portion 50.

Figure 12:
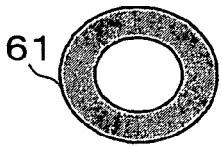
FIG. 12(*a*) is a plan view of a container internal member used for manufacturing the ink catching portion shown in FIG. 11, FIG. 12(*b*) is a longitudinal sectional view of the container internal member, FIG. 12(*c*) is a perspective view showing the operation for forming an injection hole in a process of manufacturing the ink catching portion, FIG. 12(*d*) is a plan view of a container external member used for manufacturing the ink catching portion, FIG. 12(*e*) is a longitudinal sectional view of the container external member, and FIG. 12(*f*) is a plan view showing a state in which the container internal member and the container external member are superimposed.
Figure 12:
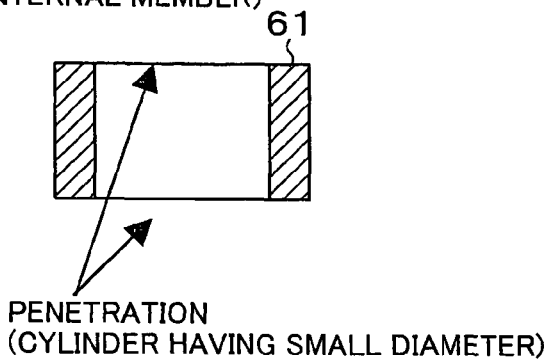
Figure 12:
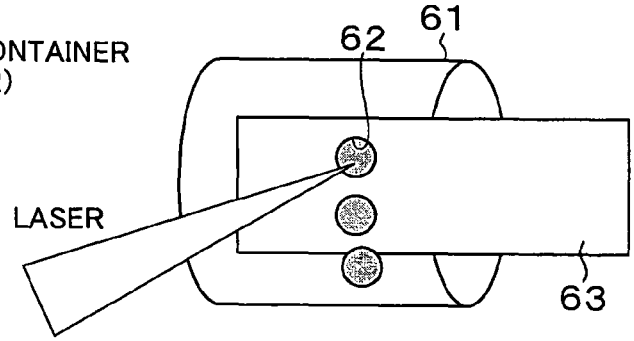
Figure 12:
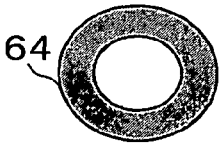
Figure 12:
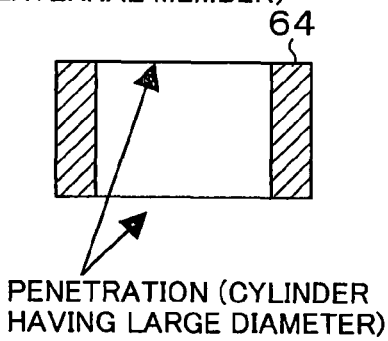
Figure 12:
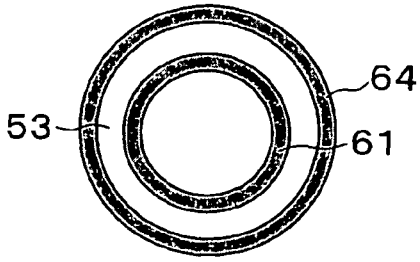

As shown in FIGS. 12(*a*) and 12(*b*), the first is to grind a ceramics material (insulating material) made of alumina, so as to create a container internal member 61 that is in the form of a cylinder. Note that FIG. 12(*a*) is a plan view of the container internal member 61, and FIG. 12(*b*) is a longitudinal sectional view of the container internal member 61.

As shown in FIG. 12(*c*), the next is to create an injecting hole 62 of the container internal member 61 so that a solution is injected from the flow path 53 to the inside of the container. This injecting hole 62 is created by, for example, inserting a shielding member 63 in the container internal member 61 and irradiating an excimer laser with respect to an external surface of the container internal member 61. With this, it is possible to create the injecting hole 62 having, for example, Φ10 μm. Note that FIG. 12(*c*) is a perspective view showing an operation of creating the injecting hole 62.

As shown in FIGS. 12(*d*) and 12(*e*), the next is to create a container external member 64 by using the same material as the container internal member 61. The container external member 64 is created by using the same method as the container internal member 61. The container external member 64 has an internal diameter larger than an external form of the container internal member 61. Note that FIG. 12(*d*) is a plan view of the container external member 64, and FIG. 12(*e*) is a longitudinal sectional view of the container external member 64.

As shown in FIG. 12(*f*), the container internal member 61 and container external member 64 created as above are so provided as to overlap. A space therebetween is the flow path 53. Note that FIG. 12(*f*) is a plan view showing the container internal member 61 and the container external member 64 which overlap each other.

Figure 13:
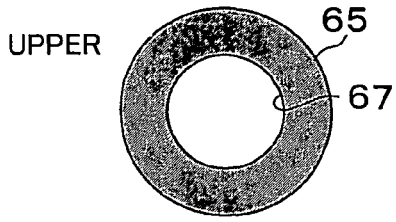
FIG. 13(*a*) is a plan view of an upper lid member used for manufacturing the ink catching portion shown in FIG. 11, FIG. 13(*b*) is a plan view of a lower lid member used for manufacturing the ink catching portion shown in FIG. 11, FIG. 13(*c*) is a perspective view showing the operation of adhering the upper lid member and the lower lid member to the container internal member and the container external member in the process of manufacturing the ink catching portion, FIG. 13(*d*) is a plan view of the ink catching portion, FIG. 13(*e*) is a perspective view showing the process of welding, using laser beam exposure, the upper lid member and the lower lid member with respect to an assembly of the container internal member and the container external member.
Figure 13:
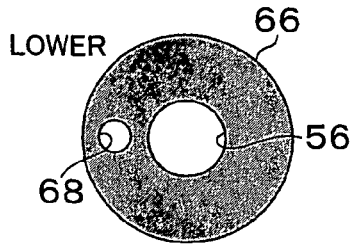
Figure 13:
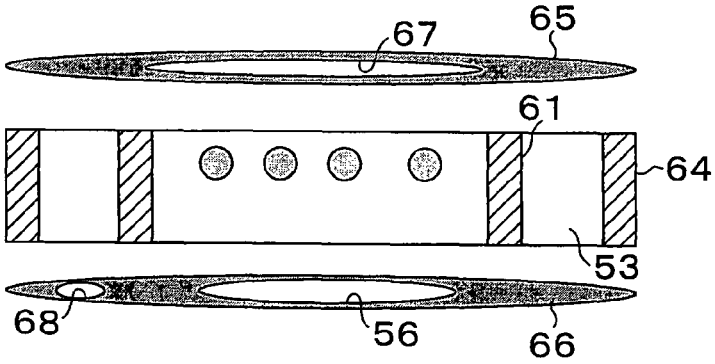
Figure 13:
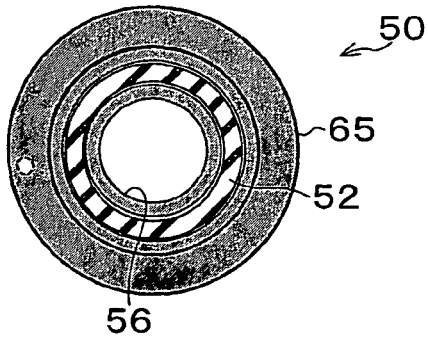
Figure 13:
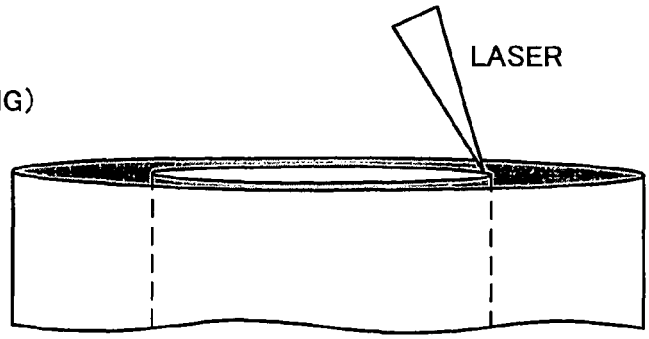

The next is to create an upper lid member 65 shown in FIG. 13(*a*) and a lower lid member 66 shown in FIG. 13(*b*). The upper lid member 65 is in the form of a doughnut, and has an opening 67 at the center thereof so as to expose the inside of the container. That is, the upper lid member is for closing the upper surface of the flow path 53. The lower lid member 66 has (i) an inflow hole 68 for allowing fluid to flow to the flow path 53 and (ii) the discharging opening 56 for allowing fluid to be discharged from the container. The inflow hole 68 and the discharging opening 56 can be formed by laser machining. Note that FIG. 13(*a*) is a plan view of the upper lid member 65, FIG. 13(*b*) is a plan view of the lower lid member 66.

As shown in FIG. 13(*c*), the next is to adhere the upper lid member 65 and the lower lid member 66 to the container internal member 61 and the container external member 64 shown in FIG. 12(*f*) in a state in which the flow path 53 is formed between the container internal member 61 and the container external member 64. For example, an insulating epoxy adhesive agent is used for this adherence. Note that the adhesive agent may be applied to entire adhesive surfaces of the upper lid member 65 and the lower lid member 66, or in this case, it is possible to apply the adhesive agent by soaking the upper lid member 65 and the lower lid member 66 in the adhesive agent. Note that FIG. 13(*c*) is a perspective view showing an operating of adhering the upper lid member 65 and the lower lid member 66 to the container internal member 61 and the container external member 64.

As shown in FIG. 13(*d*), the next is to provide the attraction electrode portion 52 on the lower lid member 66 inside the container internal member 61 in the above-described assembly. Note that FIG. 13(*d*) is a plan view of the ink catching portion 50.

The last is to provide an open-close portion 57 (open-close lid) with respect to the discharging opening 56 so that the amount of flowing fluid is controlled. Thus, the manufacturing of the ink catching portion 50 is terminated. Note that the present invention is not limited to a configuration in which the open-close portion 57 is provided with respect to the discharging opening 56, and may have a configuration (using a valve) in which the open-close portion 57 is provided between the discharging opening 56 and the solution collecting device 59 shown in FIG. 11(*d*).

The manufacturing of the ink catching portion 50 by the above-described method can be easily carried out by using an existing precision machine. If members of the container are made of metal, the joining of the upper lid member 65 and lower lid member 66 with respect to the container internal member 61 and container external member 64 can be carried out by local melting (welding) using laser beam irradiation, instead of the adhesive agent. Moreover, the manufacturing of the container having the above-described configuration can be carried out by, for example, an optical shaping technique.

Moreover, in the ink jet apparatus of the present embodiment having a function of washing the inside of the ink catching portion 50, it is preferable to include a step of washing the ink catching portion 50.

Figure 14:
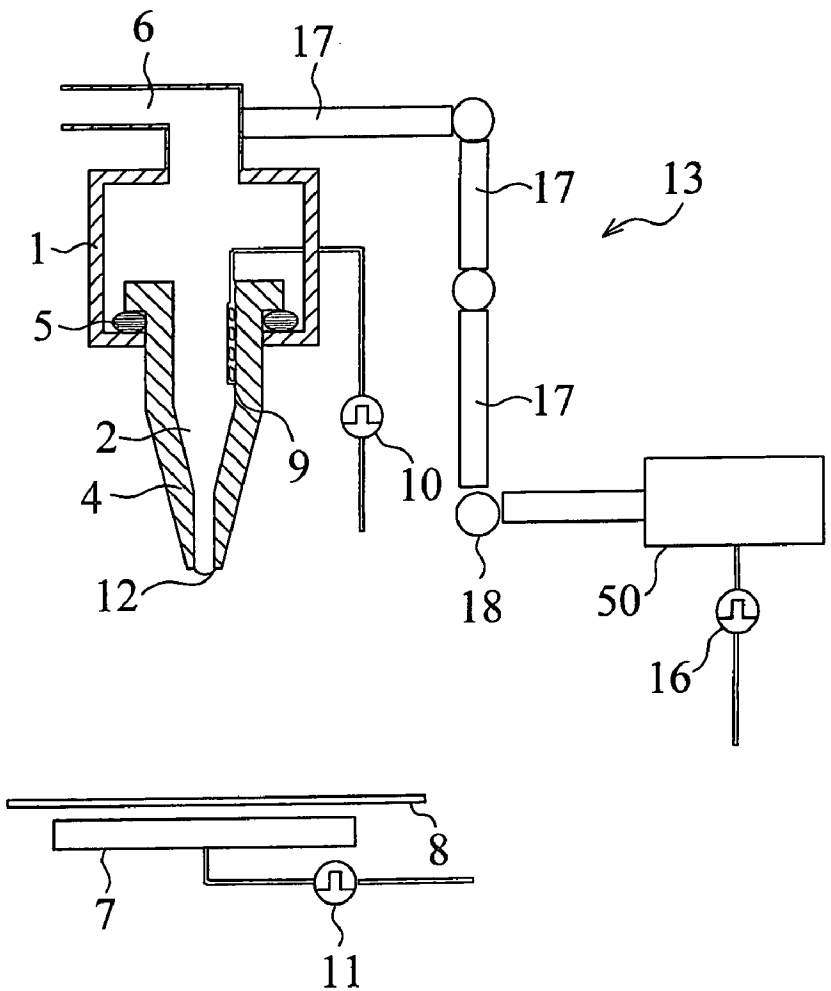
FIG. 14(*a*) is an explanatory diagram showing a state of the drawing operation by the ink jet apparatus including the ink catching portion shown in FIG. 11, and FIG. 14(*b*) is an explanatory diagram showing a state of an operation of washing the ink catching portion of the ink jet apparatus.
Figure 14:
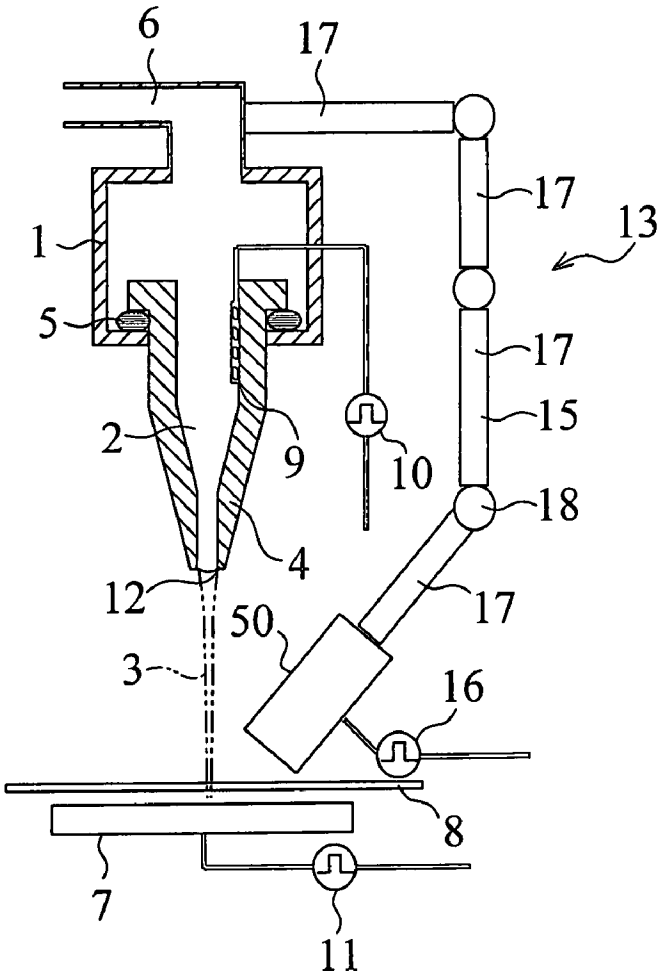

In the washing step, the ink catching portion 50 is moved (rotated) by the movement device 19 from the catching position (shown in FIG. 14(*a*)) in, for example, the drawing operation to such a position (show in FIG. 14(*b*)) that an inner bottom surface of the ink catching portion 50 and the fluid surface of the solution 54 contained in the ink catching portion 50 are in parallel with each other. With this, it is possible to appropriately wash inner surfaces, especially the bottom portion, of the ink catching portion 50 by the solution 54.

With this washing step, it is possible to prevent contamination of components of a head including the nozzle 4, the contamination being caused due to leakage of the solution 54 from the ink catching portion 50. In addition to this, it is also possible to improve the effect of washing of the ink catching portion 50.

As above, for ease of explanation, the present embodiment explained the ink jet apparatus including the ink catching portion that is in the form of a cylinder. However, the ink catching portion is not limited to this, and an ink catching portion in the form of a ball or a polyhedron is applicable as long as the ink catching portion is designed by taking into consideration an electric field between the nozzle 4 and the ink catching portion.

In addition, for ease of explanation, the present embodiment explained the ink jet apparatus including a single nozzle 4. However, the present embodiment is not limited to this, and is applicable to a multiple-head ink jet apparatus including a plurality of nozzles 4 as long as the nozzles 4 are designed by taking into consideration the influence of electric field between adjacent nozzles.

Moreover, the present embodiment explained the ink jet apparatus including the counter electrode 7, as shown in FIG. 1. However, since the distance (gap) between the counter electrode 7 and the ink ejecting hole 4*b* of the nozzle 4 does not practically affect the electric field between the printing medium 8 and the nozzle 4, the counter electrode 7 is unnecessary if the distance between the printing medium 8 and the nozzle 4 is short and a surface potential of the printing medium 8 is stable.

Moreover, the present embodiment adopts a configuration including the process control portion 10 and the process control portion 11 so that an electric field is generated between the nozzle 4 and the printing medium 8. However, it is possible to omit the process control portion 11 from this configuration since this electric field can be generated by a potential difference between the nozzle 4 and the printing medium 8.

The present invention is not limited to the embodiments above, but may be altered within the scope of the claims. An embodiment based upon a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

An electrostatic attraction fluid ejecting method and apparatus of the present invention can easily remove a clogging made in a nozzle by an ejected substance from the nozzle, and can appropriately catch the ejected substance, which is a cause of the clogging, by a conductive portion of catching means. In addition, the electrostatic attraction fluid ejecting method and apparatus of the present invention can promptly carry out as needed basis, with the nozzle provided at any position, a maintenance operation for removing the clogging and a preliminary ejection operation for, for example, adjusting the amount of ejected fluid. Therefore, the present invention is preferably utilizable to an ink jet fluid ejecting method and ink jet fluid ejecting apparatus using minute droplets and having high resolution.

The invention claimed is:

1. An electrostatic attraction fluid ejecting apparatus which electrifies fluid supplied in a nozzle, and ejects the fluid from a nozzle hole onto an ejection target member by a first electric field generated between the nozzle and the ejection target member, the electrostatic attraction fluid ejecting apparatus comprising:

catching means, provided at a position adjacent to the nozzle and including a conductive portion, for catching an ejected substance ejected from the nozzle; and voltage applying means for applying a voltage between the nozzle and the conductive portion of said catching means, the voltage being for generating a second electric field which causes the ejected substance, which is formed from the fluid or the fluid whose viscosity is changed, to be ejected from the nozzle and causes the conductive portion to attract the ejected substance;

said catching means including a catching portion which (i) is in the form of a container whose surface opposed to a top portion of the nozzle has an opening, and (ii) has the conductive portion, the conductive portion being in the form of a bar and being provided so as to project from a partial area of a bottom wall portion of the catching portion toward the opening.

2. The electrostatic attraction fluid ejecting apparatus as set forth in claim 1, wherein:

said catching means includes a catching portion which (i) is in the form of a container whose surface opposed to a top portion of the nozzle has an opening, and (ii) has the conductive portion, and the catching portion is provided at a catching position for catching the ejected substance from the nozzle, that is, the catching portion is provided such that a normal line of a central point of a bottom surface of the catching portion passes through the top portion of the nozzle.

3. The electrostatic attraction fluid ejecting apparatus as set forth in claim 1, wherein: said catching means includes a catching portion which (i) is in the form of a container whose surface opposed to a top portion of the nozzle has an opening, and (ii) has the conductive portion; and the conductive portion is provided at a bottom wall portion of the catching portion.

4. The electrostatic attraction fluid ejecting apparatus as set forth in claim 1, wherein said catching means includes: a catching portion having the conductive portion; a supporting portion which supports the catching portion so as to allow the catching portion to move; and a moving portion which causes the catching portion to move to (i) a catching position for catching the ejected substance ejected from the nozzle and (ii) an escaped position which is further from the nozzle than the catching position.

5. The electrostatic attraction fluid ejecting apparatus as set forth in claim 1, wherein:

said catching means includes a catching portion which (i) is in the form of a container whose surface opposed to a top portion of the nozzle has an opening, and (ii) has the conductive portion;

the catching portion has (i) a solution path whose one end opens at an external surface of the catching portion and whose another end opens at an internal surface of the catching portion and (ii) a discharging opening for discharging a solution from the catching portion; and said one end of the solution path is connected with solution supplying means for supplying the solution for dissolving the ejected substance caught by the catching portion.

6. The electrostatic attraction fluid ejecting apparatus as set forth in claim 1, wherein said voltage applying means carries out such a voltage applying operation that the first electric field is higher in intensity than the second electric field.

7. The electrostatic attraction fluid ejecting apparatus as set forth in claim 1, comprising a counter electrode positioned at a back surface of the ejection target member, wherein: said voltage applying means applies a voltage for generating the first electric field between the nozzle and the counter electrode; and when generating the second electric field between the nozzle and the conductive portion of said catching means, a voltage applied to the counter electrode is set to have a same polarity as a voltage applied to the nozzle.

8. The electrostatic attraction fluid ejecting apparatus as set forth in claim 1, wherein:

said catching means includes:

a catching portion having the conductive portion, a supporting portion which supports the catching portion so as to allow the catching portion to move, and a moving portion which causes the catching portion to move to (i) a catching position for catching the ejected substance ejected from the nozzle and (ii) an escaped position which is further from the nozzle than the catching position; and the electrostatic attraction fluid ejecting apparatus further comprises: a counter electrode positioned at a back surface of the ejection target member, wherein: said voltage applying means applies a voltage for generating the second electric field and also applies a voltage for generating the first electric field between the nozzle and the counter electrode; and when generating the second electric field between the nozzle and the conductive portion of said catching means, a voltage applied to the counter electrode is set to have a same polarity as a voltage applied to the nozzle, the counter electrode being positioned below the nozzle, and the catching portion being moved to the catching position by the moving portion when said voltage applying means generates the second electric field, and the catching portion being positioned at the catching position in such a manner as to be above the counter electrode.

9. The electrostatic attraction fluid ejecting apparatus as set forth in claim 3, wherein, on or above the conductive portion in the catching portion, an absorber member capable of absorbing the fluid is provided.

10. The electrostatic attraction fluid ejecting apparatus as set forth in claim 5, wherein:

said solution supplying means has a function of controlling the amount of solution supplied to the catching portion; and the discharging opening is connected with collecting means for collecting the solution in the catching portion in accordance with an instruction from said solution supplying means.

11. The electrostatic attraction fluid ejecting apparatus as set forth in claim 10, wherein said catching means includes: a catching portion having the conductive portion; a supporting portion which supports the catching portion so as to allow the catching portion to move; and a moving portion which causes the catching portion to move to (i) a catching position for catching the ejected substance ejected from the nozzle and (ii) an escaped position which is further from the nozzle than the catching position and at which a bottom surface of the catching portion is substantially in parallel with a surface of the solution supplied to the catching portion.

* * * * *